US007815388B2

(12) United States Patent
Busam et al.

(10) Patent No.: US 7,815,388 B2
(45) Date of Patent: Oct. 19, 2010

(54) RETRACTABLE WRITING SURFACE

(75) Inventors: Edward P. Busam, Mason, OH (US); Bertholt Ludwig Ted Schroeder, Franklin, MA (US); Jeffrey T. DeBord, Worthington, OH (US)

(73) Assignee: MeadWestvaco Corporation, Richmond, VA (US)

( * ) Notice: Subject to any disclaimer, the term of this patent is extended or adjusted under 35 U.S.C. 154(b) by 1102 days.

(21) Appl. No.: 11/293,950

(22) Filed: Dec. 5, 2005

(65) Prior Publication Data

US 2006/0257200 A1 Nov. 16, 2006

(51) Int. Cl.
*B43K 29/00* (2006.01)
*B42F 13/00* (2006.01)

(52) U.S. Cl. ..... 401/195; 402/73; 402/79; 402/80 P

(58) Field of Classification Search ..... 401/17, 401/18, 21, 23, 25, 34, 73, 195, 198, 199; 402/70, 71, 79, 73, 502, 80 P; 281/31, 39; 283/40

See application file for complete search history.

(56) References Cited

U.S. PATENT DOCUMENTS

| | | | | |
|---|---|---|---|---|
| 1,316,039 | A | 9/1919 | James | |
| 2,696,992 | A | 12/1954 | Duff | |
| 3,025,834 | A | 3/1962 | Aaron | |
| 3,077,184 | A | 2/1963 | Vogel | |
| D220,296 | S | 3/1971 | Berlin | |
| 3,684,389 | A | 8/1972 | Eron et al. | |
| 3,828,696 | A | 8/1974 | Lockridge | |
| 3,941,488 | A | 3/1976 | Maxwell | |
| 3,985,455 | A | 10/1976 | Wahlberg | |
| 4,213,717 | A | 7/1980 | Lin | |
| 4,221,490 | A | 9/1980 | Malm | |
| 4,357,431 | A | 11/1982 | Murakami et al. | |
| 4,441,270 | A | 4/1984 | Crowell et al. | |
| 4,509,875 | A | 4/1985 | Shintani | |
| D279,992 | S | 8/1985 | Gribb | |
| 4,549,827 | A | 10/1985 | Mack | |
| 4,557,618 | A | 12/1985 | Iwata et al. | |
| 4,600,327 | A | 7/1986 | Guzman | |
| 4,629,349 | A * | 12/1986 | Pitts | 402/74 |
| D295,878 | S | 5/1988 | Lovell | |
| 4,744,689 | A | 5/1988 | Sternberg | |
| D303,683 | S | 9/1989 | Brock | |
| 4,865,479 | A | 9/1989 | Doll | |
| D306,316 | S | 2/1990 | Shintani | |
| D306,873 | S | 3/1990 | Yazaki | |
| D307,602 | S | 5/1990 | Lee | |
| 4,979,840 | A | 12/1990 | Madaus et al. | |
| 5,033,895 | A | 7/1991 | Aida | |
| 5,044,807 | A | 9/1991 | Meservy et al. | |

(Continued)

*Primary Examiner*—Tuan N Nguyen
(74) *Attorney, Agent, or Firm*—MWV Intellectual Property Group

(57) ABSTRACT

A retractable writing surface system including a binding mechanism and a pocket directly bound to the binding mechanism, the pocket having an inner cavity. The system further includes a polymer writing surface at least partially received in the pocket. The writing surface is movable between an extended position wherein at least part of the writing surface is exposed for writing upon by a writing instrument, and a retracted position wherein less of the writing surface is exposed for writing upon by the writing instrument compared to when the writing surface is in the extended position. At least part of the writing surface is located in the cavity when the writing surface is in the retracted position.

31 Claims, 21 Drawing Sheets

U.S. PATENT DOCUMENTS

| | | | | |
|---|---|---|---|---|
| 5,072,483 | A | 12/1991 | Durand | |
| 5,114,259 | A | 5/1992 | Meservy et al. | |
| 5,118,213 | A | 6/1992 | Meservy et al. | |
| 5,123,766 | A | 6/1992 | Babiak | |
| 5,131,776 | A | 7/1992 | Mott | |
| D330,388 | S | 10/1992 | Choi | |
| 5,169,255 | A | 12/1992 | Jensen | |
| D336,425 | S | 6/1993 | Napora, Jr. | |
| 5,338,123 | A | 8/1994 | Obersteller et al. | |
| 5,427,278 | A | 6/1995 | Gardner, III | |
| 5,432,973 | A | 7/1995 | Wagner et al. | |
| 5,476,336 | A | 12/1995 | Osiecki et al. | |
| 5,489,331 | A | 2/1996 | Miller et al. | |
| 5,492,558 | A | 2/1996 | Miller et al. | |
| 5,578,117 | A | 11/1996 | Matz et al. | |
| 5,649,999 | A | 7/1997 | Wang | |
| 5,678,943 | A | 10/1997 | Parsons | |
| 5,702,513 | A | 12/1997 | Causton et al. | |
| D404,069 | S | 1/1999 | Hasegawa | |
| 5,855,442 | A | 1/1999 | Keller | |
| 5,871,294 | A | 2/1999 | Turner | |
| 5,895,160 | A | 4/1999 | Ginelli | |
| 5,897,265 | A | 4/1999 | Wilson | |
| 5,915,873 | A | 6/1999 | Karlis | |
| 5,957,700 | A | 9/1999 | Ariyama | |
| 6,004,057 | A | 12/1999 | Fulop | |
| 6,019,535 | A | 2/2000 | Turner | |
| 6,031,023 | A | 2/2000 | Carroll et al. | |
| 6,045,161 | A | 4/2000 | Ashcraft et al. | |
| 6,048,121 | A | 4/2000 | Carver | |
| 6,095,707 | A | 8/2000 | Kaufmann | |
| 6,179,501 | B1 | 1/2001 | Fulop | |
| 6,183,155 | B1 | 2/2001 | Kaufmann | |
| 6,209,778 | B1 | 4/2001 | Henrikson et al. | |
| 6,250,006 | B1 | 6/2001 | Berrier | |
| D445,130 | S | 7/2001 | Ginelli | |
| D451,139 | S | 11/2001 | Wang | |
| 6,344,498 | B1 | 2/2002 | Allison et al. | |
| 6,347,898 | B1 | 2/2002 | Rhodes et al. | |
| 6,379,001 | B1 | 4/2002 | Tomida et al. | |
| 6,413,001 | B1 | 7/2002 | Kaufmann | |
| 6,435,747 | B2 | 8/2002 | Furukawa et al. | |
| 6,491,464 | B1 | 12/2002 | Young | |
| 6,497,527 | B2 | 12/2002 | Kaufmann | |
| 6,505,984 | B2 | 1/2003 | Smith et al. | |
| D471,586 | S | 3/2003 | Geiselhart et al. | |
| 6,565,275 | B2 | 5/2003 | Brand et al. | |
| 6,607,216 | B1 | 8/2003 | Stenger et al. | |
| 6,769,829 | B1 | 8/2004 | Castillo et al. | |
| 6,932,531 | B2 | 8/2005 | Marschand | |
| 7,264,119 | B2 * | 9/2007 | Navickas | 206/390 |
| 2001/0016141 | A1 | 8/2001 | Kaufmann | |
| 2002/0159817 | A1 | 10/2002 | Brand et al. | |
| 2003/0155761 | A1 | 8/2003 | Stenger et al. | |
| 2003/0157472 | A1 | 8/2003 | Castillo et al. | |
| 2004/0136774 | A1 * | 7/2004 | O'Boyle | 402/73 |
| 2004/0213627 | A1 | 10/2004 | Marschand et al. | |
| 2005/0150423 | A1 | 7/2005 | Godbout | |
| 2005/0158113 | A1 | 7/2005 | Wehmeyer | |
| 2005/0175390 | A1 | 8/2005 | Wehmeyer | |

* cited by examiner

RETRACTABLE WRITING SURFACE

The present invention is directed to a writing surface, and, more particularly, to a retractable writing surface that is movable between an extended position and a retracted position.

BACKGROUND

Bound components, such as journals, diaries, date books, address books, notebooks, binders and the like are used to store papers, information and the like. Users may wish to write reminders or other indicia on these bound components, and some bound components may include an outer cover which can be written upon such that the information is more readily viewable.

However, many outer covers are permanently marred when a user writes upon the outer cover. In addition, when a user writes indicia on the outer cover, the indicia may be visible and exposed, and therefore can expose sensitive information. Accordingly there is a need for a writing surface that is retractable such that the bound component can maintain a clean outer appearance, and such that the indicia written thereon can be hidden from view.

SUMMARY

In one embodiment the present invention is a writing surface that is retractable such that the bound component can maintain a clean outer appearance, and such that the indicia written thereon can be hidden from view. More particularly, in one embodiment the invention is a retractable writing surface system including a binding mechanism and a pocket directly bound to the binding mechanism, the pocket having an inner cavity. The system further includes a polymer writing surface at least partially received in the pocket. The writing surface is movable between an extended position wherein at least part of the writing surface is exposed for writing upon by a writing instrument, and a retracted position wherein less of the writing surface is exposed for writing upon by the writing instrument compared to when the writing surface is in the extended position. At least part of the writing surface is located in the cavity when the writing surface is in the retracted position.

In another embodiment the invention is a marking system including a permanent writing instrument configured to dispense permanent markings and erasing means for erasing the permanent markings. The system further includes a writing surface directly or indirectly coupled to the writing instrument and the erasing means. The writing surface is configured such that the marking portion is able to dispenses the permanent markings thereon and the markings are erasable by the erasing means. The writing surface is movable between an extended position wherein at least part of the writing surface is exposed for writing upon by the writing instrument, and a retracted position wherein less of the writing surface is exposed for writing upon by the writing instrument compared to when the writing surface is in the extended position.

BRIEF DESCRIPTION OF THE DRAWINGS

The invention can be understood with reference to the following drawings. In the drawings, like reference numerals designate corresponding parts throughout the several views. Also, the components in the drawings are not necessarily to scale.

DETAILED DESCRIPTION

Figure 1:
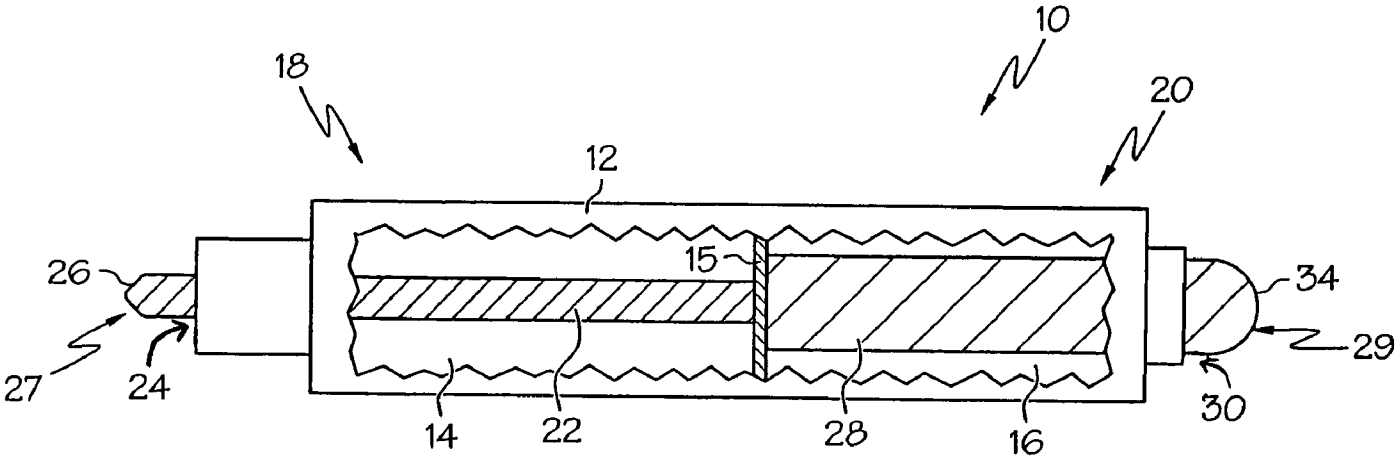
FIG. 1 is a front view of a marker with a portion of the marker body cut away.

With reference to FIG. 1, a marker or writing instrument 10 is shown and includes a writing instrument body or marker body 12. The marker body 12 may be generally tubular or cylindrical and may have a first portion 18 and a second portion 20. The marker body 12 may include a first reservoir 14 located generally inside of the first portion 18 and a second reservoir 16 located generally inside of the second portion 20, with the first 14 and second 16 reservoirs separated by a divider 15. The maker body 12 may include a first opening 24 that is located at an end of the marker body 12 and in communication with the first reservoir 14. The marker body 12 may also include a second opening 30 that is located at the other of the marker body 12 and in communication with the second reservoir 16.

The marker body 12 includes a first wick 22 generally closely received in and through the first opening 24 and extending into the first reservoir 14. The first wick 22 has an exposed portion 27 extending out of the first reservoir 14, with the exposed portion 27 having or forming a writing tip 26. The marker body 12 includes a second wick 28 generally closely received in and through the second opening 30 and extending into the second reservoir 16. The second wick 28 has an exposed portion 29 extending out of the second reservoir 16, with the exposed portion 29 including or forming a tip 34. The wicks 22, 28 may be made from a wide variety of materials, such as felt. Although the marker 10 is illustrated as having a tip 26, 34 at each end, the marker 10 may have a wide variety of other configurations for the tips 26, 34 and/or wicks 22, 28, including having the tips 26, 34, being oriented at various angles, being located in a side-by-side configuration, having only a single tip, etc.

The first reservoir 14 may be filled with a permanent or indelible ink solution of any of a wide variety of colors. The permanent ink or permanent ink solution in the first reservoir 14 may be nearly any type of permanent ink or ink solution, such as a traditional organic solvent based permanent ink with a wide variety of pigments, dye, colorants or the like, or an aqueous type permanent ink as described in U.S. Pat. No. 5,131,776, the entire contents of which are hereby incorporated by reference. The permanent ink may be an alcohol (i.e. n-propyl alcohol) based or other organic solvent based permanent ink. The permanent ink may be capable of marking on porous surfaces (e.g., paper, wood and the like) and nonporous surfaces (e.g., glass, metal, plastic and other polymer based surfaces). Further, the permanent ink may be resistent to smearing and re-wetting after application and may resist emulsification, dissolving or removal with soap and water.

The second reservoir 16 may be filled with a solvent that can dissolve the permanent ink or ink solution in the first reservoir 14. The solvent in the second reservoir 16 may be any solvent that is capable of solubilizing or dissolving permanent ink or a permanent ink solution that has been applied to a surface and allowed to dry. The solvent may be or include an ethyl alcohol, an n-propyl alcohol, or other organic based solvents.

For example, the solvent may be a dry-erase solution typically used in a dry-erase marker. Thus the solvent may also optionally include a colorant, dye or pigment and a binder resin such that the second portion 20 can operate as a dry-erase marker. In this case, when the dry-erase solution is applied to a polymeric or plastic type surface, the solvent evaporates and the binder resin and colorant remain behind as a friable discontinuous film.

The permanent ink solution in the first reservoir 14 may be soaked through the first wick 22, or permanent ink dispensing wick 22, and wicked through the permanent ink dispensing wick 22 until the permanent ink solution reaches the writing tip 26. In this manner, when the writing tip 26 contacts a substrate to be written upon, ink from the first reservoir 14 is deposited on the substrate. Similarly, the solvent in the second reservoir 16 soaks the second wick 28, or solvent dispensing wick 28, such that the solvent is wicked through the solvent dispensing wick 28 until it reaches the erasing tip 34. When the erasing tip 34 contacts the substrate, solvent from the second reservoir 16 is deposited onto the substrate and solubilizes (or dissolves) any ink deposited by the permanent ink dispending wick contacted by the solvent. Thus the marker 10 may be a double-ended felt-tip marker, although the marker 10 may include various other manners of dispensing the permanent ink and solvent, such as ball-point dispensers, gel-type dispensers, etc.

Figure 2:
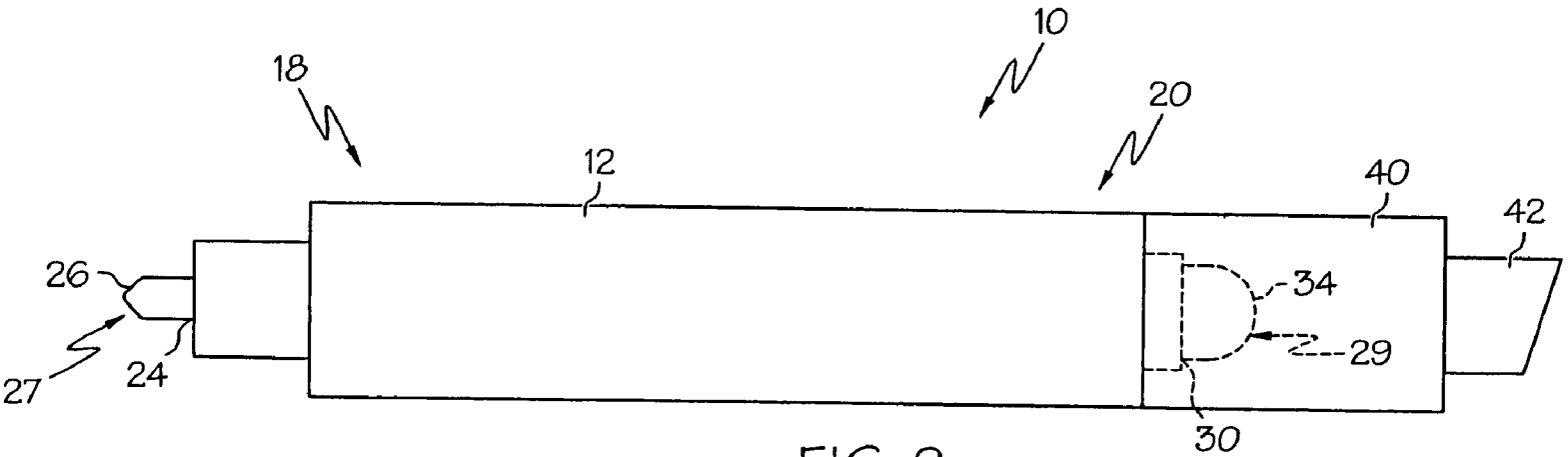
FIG. 2 is a front view of the marker of FIG. 1 including a cap mounted thereon.

The marker 10 may include a cap 40 for covering either the erasing tip 34 (as shown in FIG. 2) or, alternatively or in addition, the writing tip 26. The cap 40 prevents the ink and solvent from evaporating through the wicks 22, 28 when the marker 10 is not in use. For example, as shown in FIG. 2, the cap 40 may include a body portion shaped to form a tight interference fit or seal with the marker body 12 to seal off the associated tip 26, 34. The cap 40 may also include an absorbent portion 42 located, for example, on an outer surface, or outer end surface, of the cap 40. The absorbent portion 42 may be made of a felt, cotton, foam, sponge-type material or other absorbent material. The absorbent portion 42 may be used to wipe away markings that are deposited by the writing tip 26 and erased/dissolved by the erasing tip 34. If desired, the marker 10 may include two caps 40, with each cap 40 located on each end of the marker 10, and at least one cap 40 may include an absorbent portion 42, although both caps 40 may include an absorbent portion 42.

Figure 3:
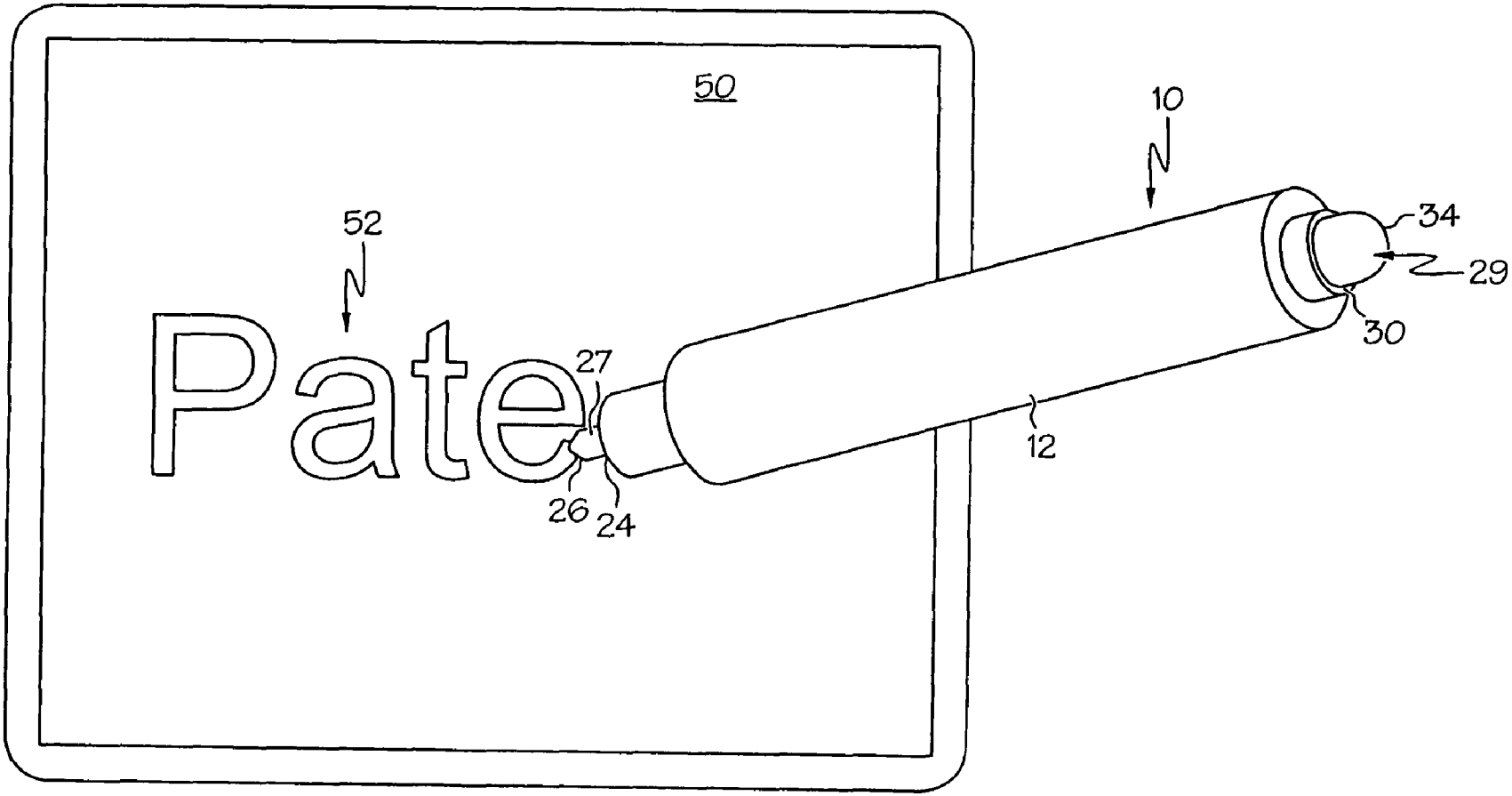
FIG. 3 is a front view of a writing surface being marked upon by the marker of FIG. 1.

As shown in FIG. 3, a user may mark various indicia or markings 52 on a writing surface 50 using the writing tip 26 of the marker 10. The markings 52 may then be allowed to dry. Once dry, the markings 52 may not be able to be erased by simply rubbing the markings by hand, or with soap and water or the like. The permanent markings 52 may then be allowed to remain in place for as long as desired. Once it is desired to erase the markings 52, the erasing tip 34 is applied to the markings 52 to solubilize/erase/dissolve the markings 52. The erasing tip 34 may be moved over the markings 52 such that the solvent contacts the deposited markings 52 and solubilizes the markings 52, thereby allowing the markings 52 to be erased. A user may then take the cap 40 and apply the absorbent portion 42 to the writing surface 50 to wipe away or absorb the solubilized markings.

The writing surface 50 may be made of a typical plastic material such as polypropylene, polyethylene or the like that is capable of being marked upon using permanent ink, but not with typical water based inks. The writing surface 50 may have a glossy finish surface and/or a UV aqueous coating and/or other coatings. The writing surface may be made of a material that is chemically resistant to any solvents dispensed by the writing instrument (i.e., erasing solutions located in the second reservoir 16).

Further, the writing surface 50 may have a surface roughness sufficient to absorb or receive ink in the creases and recesses, but not exceedingly rough to make it overly difficult to remove the ink. In one embodiment, the writing surface 50 has an average surface roughness of between about 50-1000 microns, or more particularly between about 9-100 microns. The writing surface 50, permanent ink and solvent should be selected such that application of the permanent ink or solvent to the writing surface 50 does not significantly alter, destroy or marr the writing surface 50. Proper selection may allow the writing surface 50 to be used many times over for marking and erasing.

Figure 4:
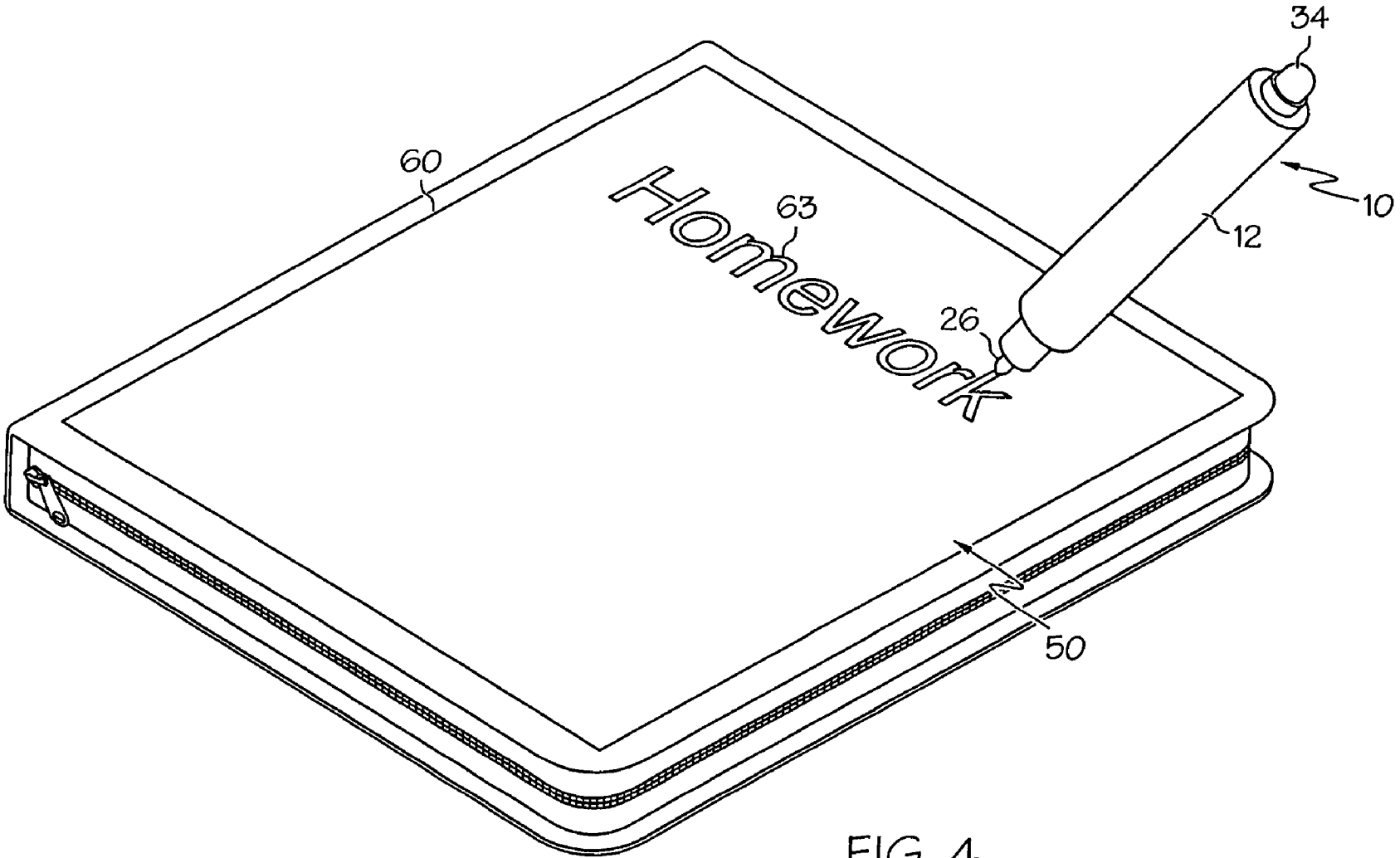
FIG. 4 is a front perspective view of a binder including a writing surface and being marked upon by the marker of FIG. 1.

The writing surface 50 may be, include, or be part of various devices or products. For example, the writing surface 50 may be formed as part of a school or office product such as a binder 60 (FIG. 4), 70 (FIGS. 5 and 6) or 80 (FIGS. 7 and 8), a notebook 90 (FIGS. 9 and 10), a folder 100 (FIG. 11), a book cover 110 (FIGS. 12 and 13), as well as a divider, portfolio, tablet, note pad, clipboard, briefcase, storage case, compact disk case, compact disk, computer case, electronic device case or the like for home, school, business, office or other use. Thus, for example, in school use, a user may write certain notes or reminders (i.e. a reminder of a homework assignment) on the outer surface of a binder 60, 70, 80 which includes the writing surface 50. The writing 63 on the binder 60 (see FIG. 4) may be written in permanent ink and therefore resists smudging and accidental erasure, even when exposed to water and most common liquids. When the user desires to remove the marking 63 (i.e. when the homework project is complete or when a new homework assignment is received) the user can remove the markings 63 using the erasing tip 34 and absorbent portion 42 of the cap 40.

Figure 5:
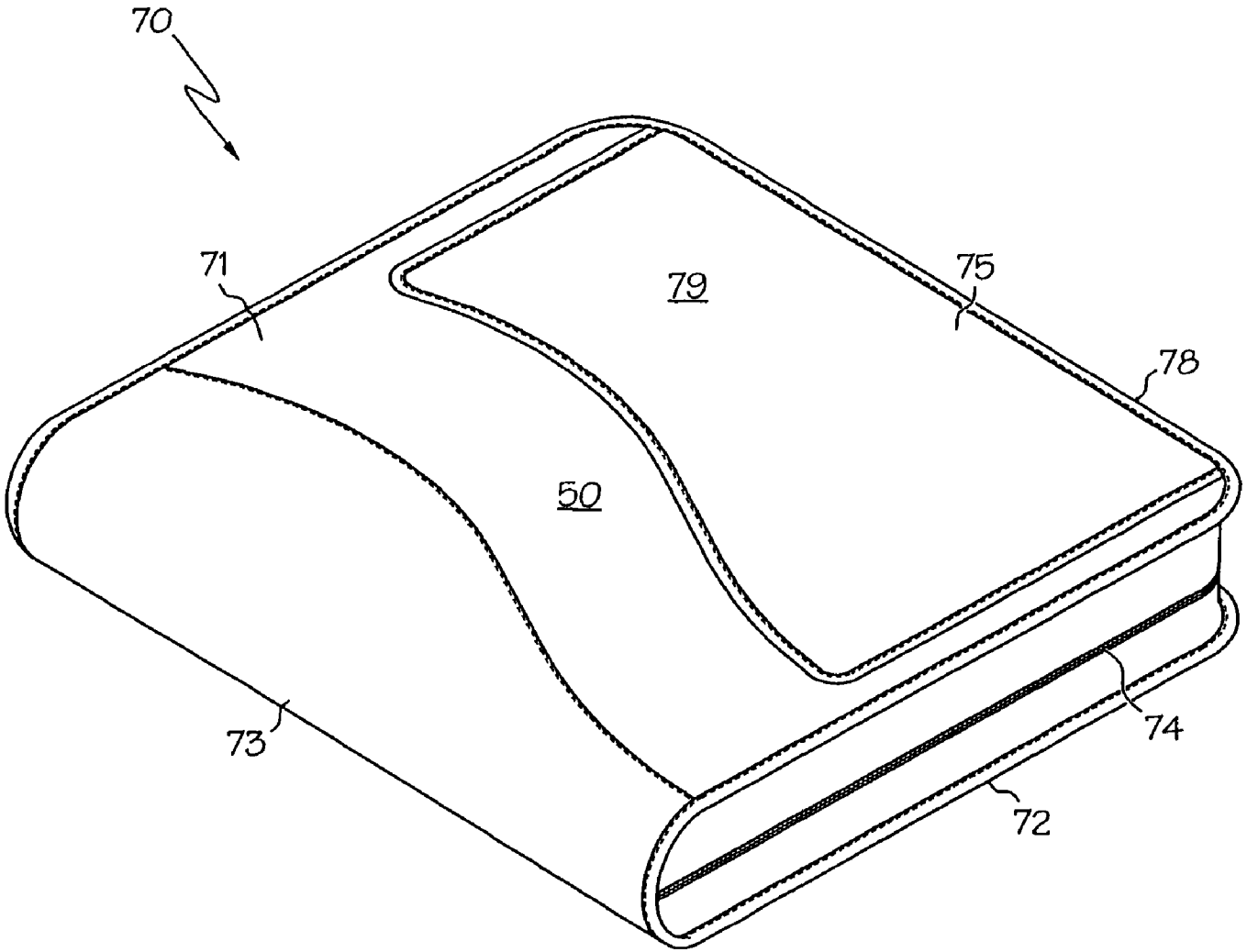
FIG. 5 is a front perspective view of a binder including a writing surface and a flap, with the flap in a closed position.
Figure 6:
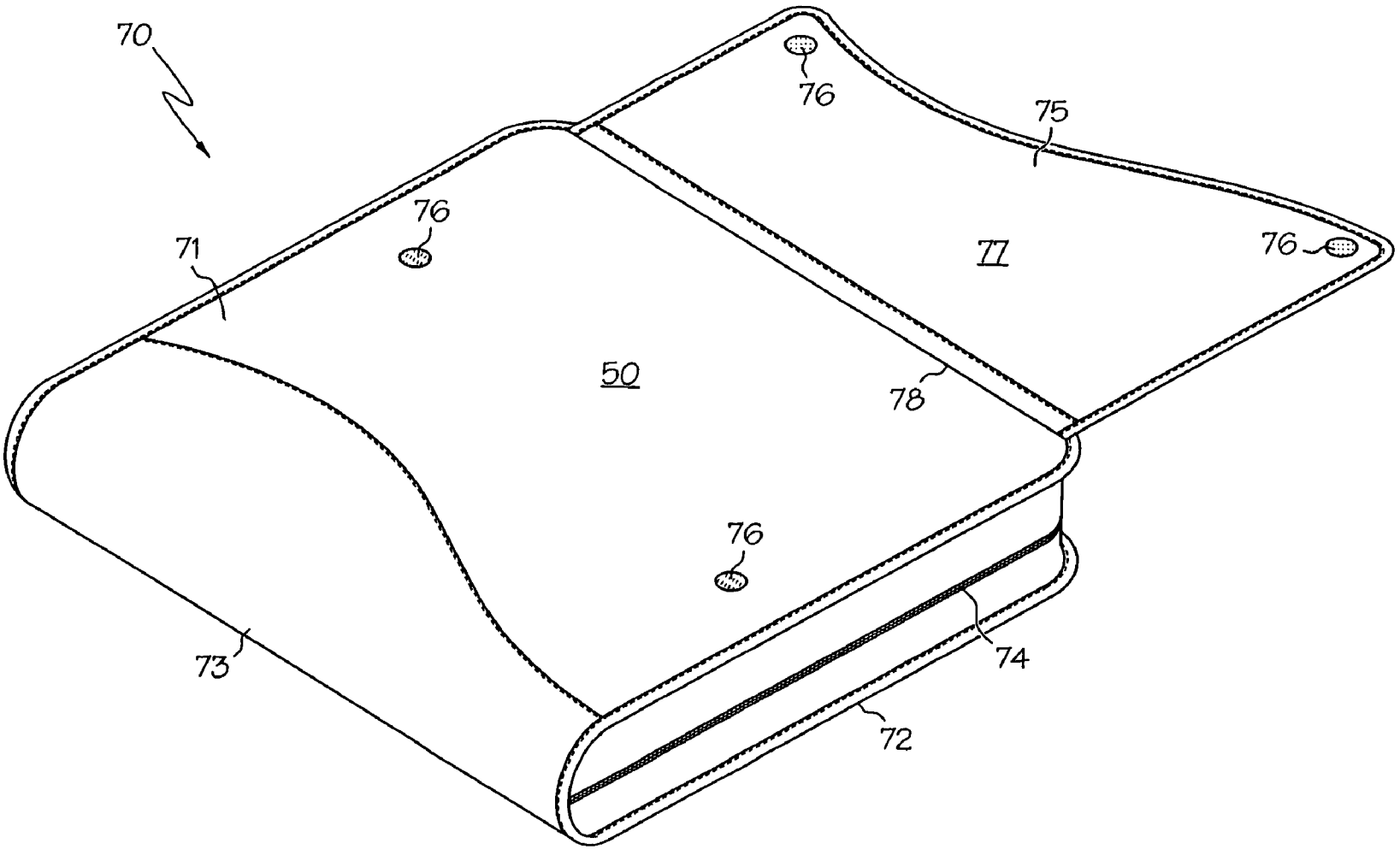
FIG. 6 is a front perspective view of the binder of FIG. 5 with the flap in an open position.

As shown in FIGS. 5 and 6, in one embodiment the binder 70 includes a front cover 71, a back cover 72 and a spine portion 73. The front cover 71 and back cover 72 are pivotally coupled to the spine portion 73. The binder 70 includes a zipper closure mechanism 74 that couples the front cover 71 and back cover 72 together. The binder 70 also includes a flap 75 (having inner surface 77 and outer surface 79) pivotally coupled to the front cover 71 and cooperating securing devices 76 located on the front cover 71 and on the inner surface 77 of the flap 75.

The writing surface 50 is formed on or as part of the front cover 71 (as shown in FIGS. 5 and 6) and/or the back cover 72 (not shown). The flap 75 is hingedly connected to an outer edge 78 of the front cover 71 and pivots from an open position, wherein the flap 75 is spaced or pivoted away from the front cover 71 (see FIG. 6) to a closed position, wherein the flap 75 lies over the front cover 71 (see FIG. 5) to cover all or a portion (anywhere from about 10% to about 100%) of the writing surface 50 on the front cover 71.

When the flap 75 is in the closed position the flap 75 protects the writing surface 50. The securing devices 76 may be positioned on the facing surfaces (i.e., inner surface 77 of flap 75 and surface 50 of front cover 71) to secure the flap 75 in its closed position. The securing devices 76 may take a variety of forms, such as hook-and-loop fasteners (i.e., VELCRO®), magnets, tacky or adhesive material, clips, snaps, or the like. The flap 75 (i.e., including inner surface 77 and outer surface 79) and/or spine portion 73 may also be made of or include a writing surface 50 (not shown).

Figure 7:
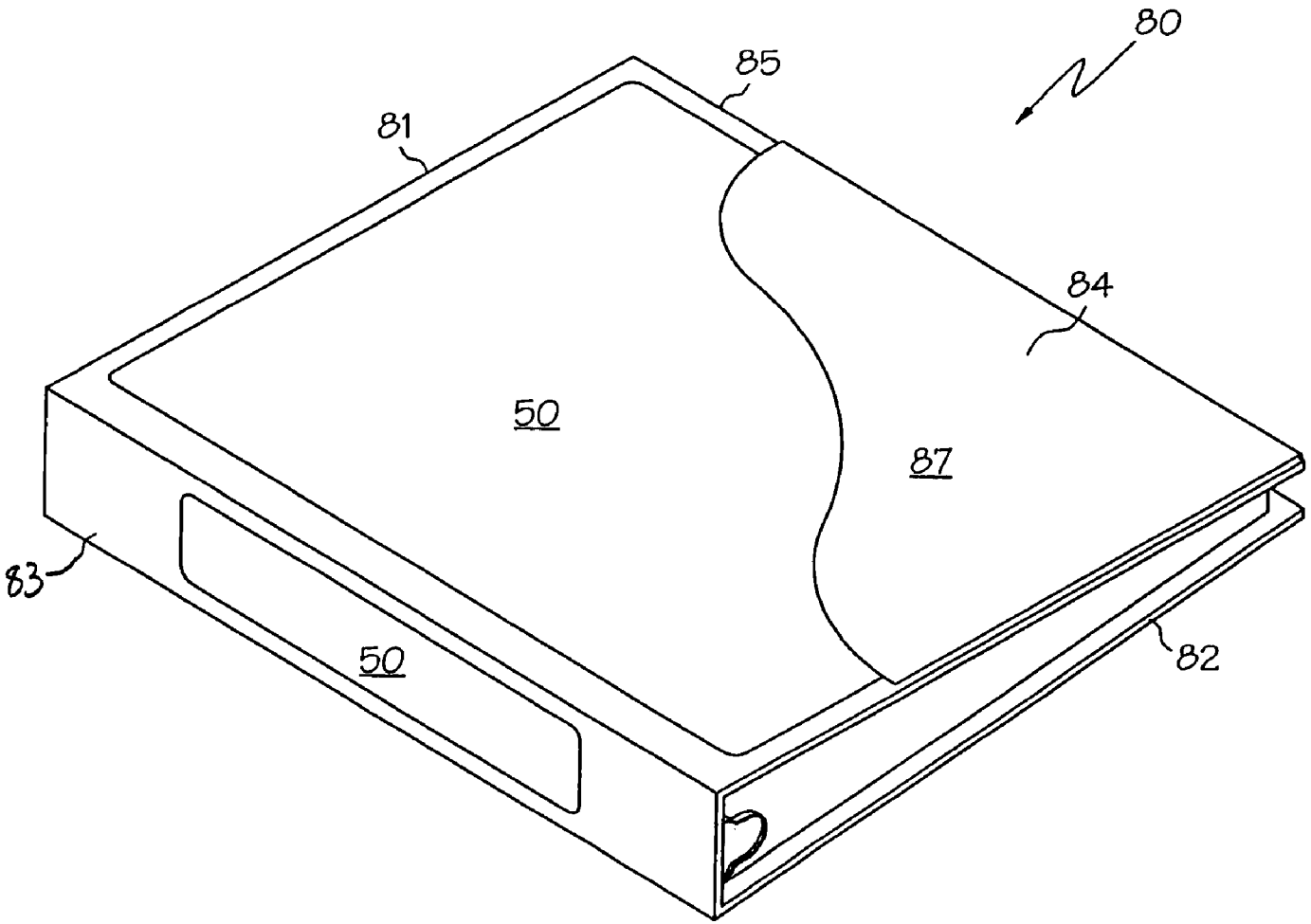
FIG. 7 is a front perspective view of a three-ring notebook including a writing surface and a flap, with the flap in a closed position.
Figure 8:
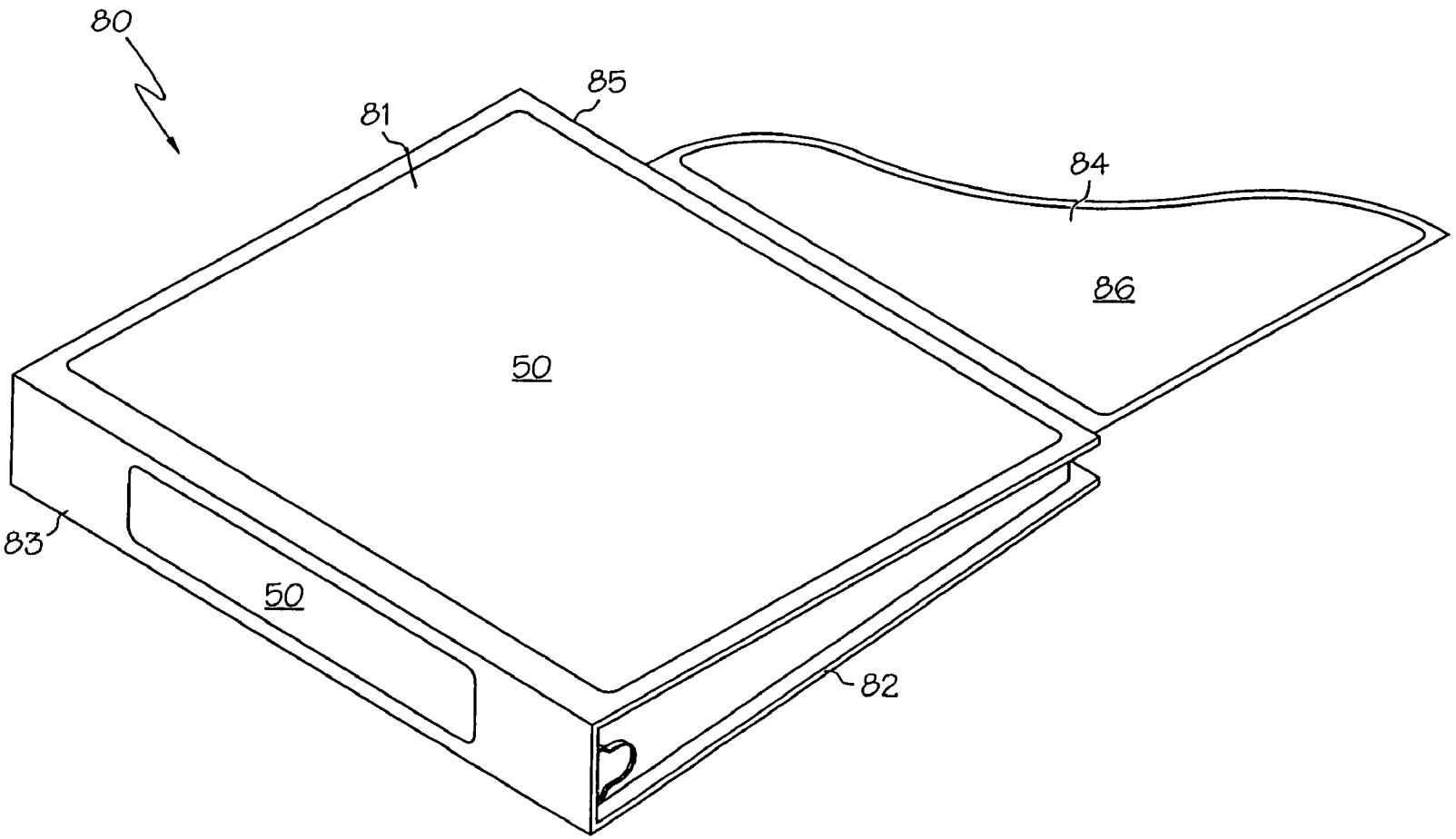
FIG. 8 is a front perspective view of the three-ring notebook of FIG. 7 with the flap in an open position.

As shown in FIGS. 7 and 8, in a second embodiment a three-ring binder 80 includes a front cover 81, a back cover 82 and a spine 83. The front cover 81 and back cover 82 are pivotally coupled to the spine 83. The binder 80 includes a flap 84 (having inner surface 86 and outer surface 87) pivotally coupled to the front cover 81 along edge 85.

The writing surface 50 is formed on or as part of the front cover 81 (and/or back cover 82) and the spine 83. The flap 84 is hingedly connected to the outer edge 85 of the front cover 81 and pivots from an open position, wherein the flap 84 is spaced or pivoted away from the front cover 81 (see FIG. 8) to a closed position, wherein the flap 84 lies over the front cover 81 (see FIG. 7) to cover all or a portion of the writing surface 50 on the front cover 81. The flap 84 may be secured to the front cover 81 (when in the closed position) by various means (not shown), such as hook-and-loop fasteners, magnets, clips, snaps, adhesive or tacky material or the like. In an alternative embodiment, the flap 84 also includes a writing surface 50 (not shown) located on either or both sides thereof.

Figure 9:
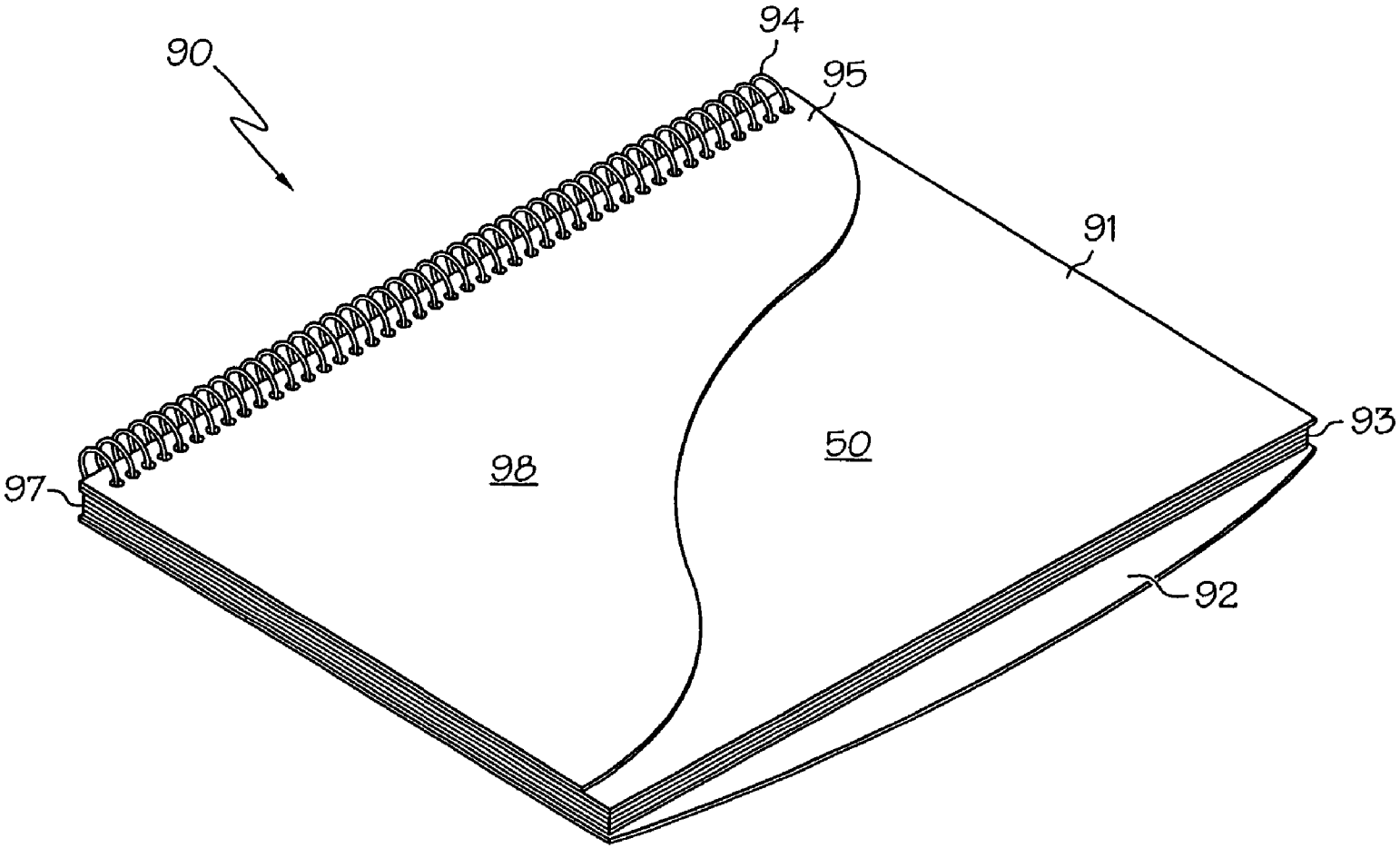
FIG. 9 is a front perspective view of a coil-bound notebook including a writing surface and a flap, with the flap in a closed position.
Figure 10:
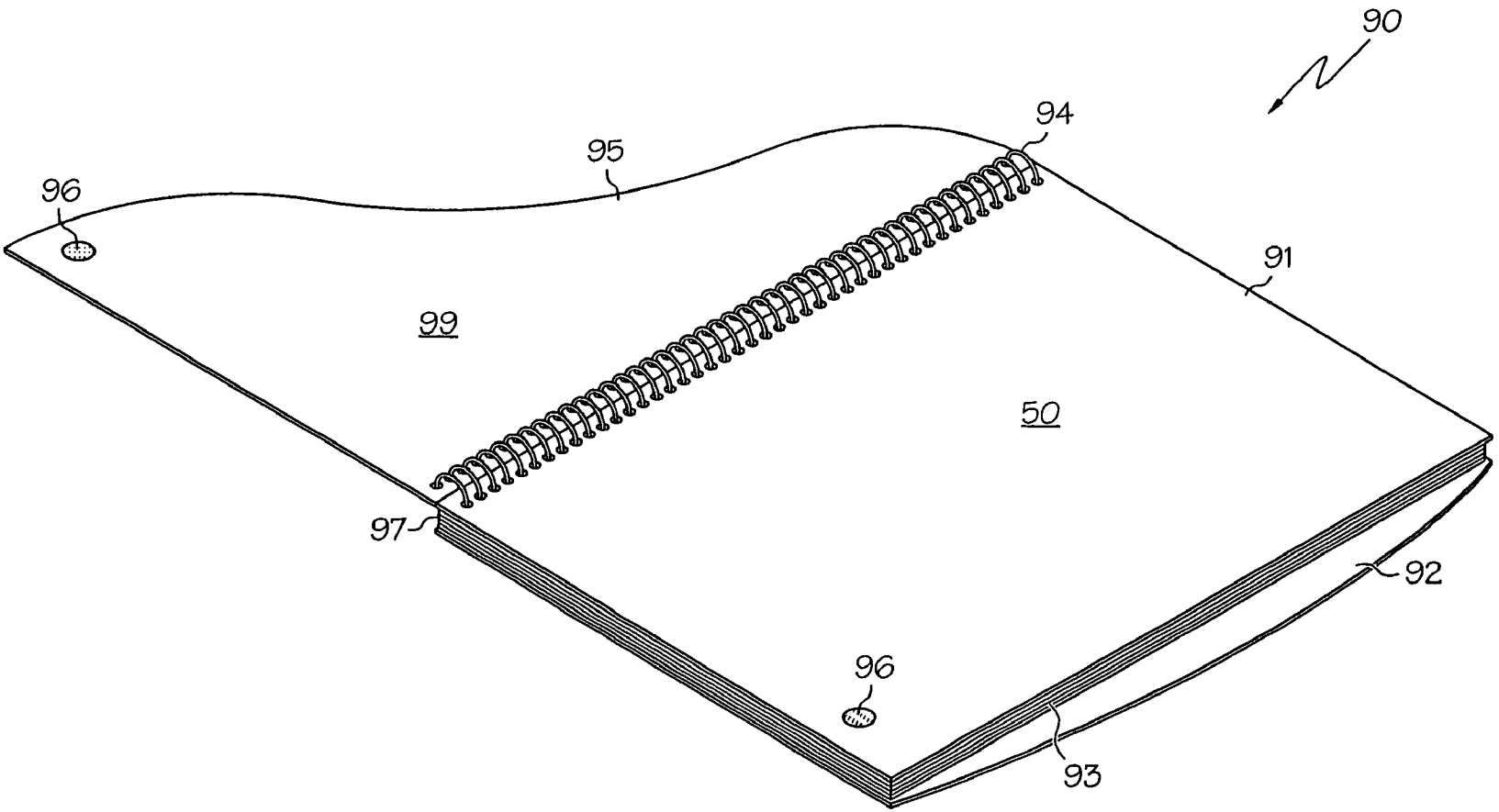
FIG. 10 is a front perspective view of the coil-bound notebook of FIG. 9 with the flap in an open position.

As shown in FIGS. 9 and 10, in a third embodiment a coil bound notebook 90 includes a front cover 91, a back cover 92, a plurality of sheets of paper 93, a coil binding mechanism 94, a flap 95 (having front surface 98 and back surface 99) and cooperating securing devices 96. The sheets of paper 93 are positioned between the front and back covers 91, 92. The flap 95, front and back covers 91, 92 and plurality of sheets of paper 93 are bound together along their binding edges 97 by coil binding 94.

In the illustrated embodiment, the writing surface 50 is formed on or as part of the front cover 91 and/or the back cover 92. Also, the front 98 (see FIG. 9) and/or back 99 surface of the flap 95 may include a writing surface 50. The flap 95 is pivotable about the coil binding mechanism 94 from an open position, wherein the flap 95 is spaced or pivoted away from the front and back covers 91, 92 (see FIG. 10) to a closed position, wherein the flap 95 lies over one of the covers 91, 92 (see FIG. 9) to cover all or a portion of the front or back covers 91, 92. The flap 95 may be secured in the closed position (i.e., to the front or back covers 91, 92) by the securing devices 96 (e.g., hook-and-loop fasteners, magnets, clips, snaps, adhesive or tacky material or the like).

Figure 11:
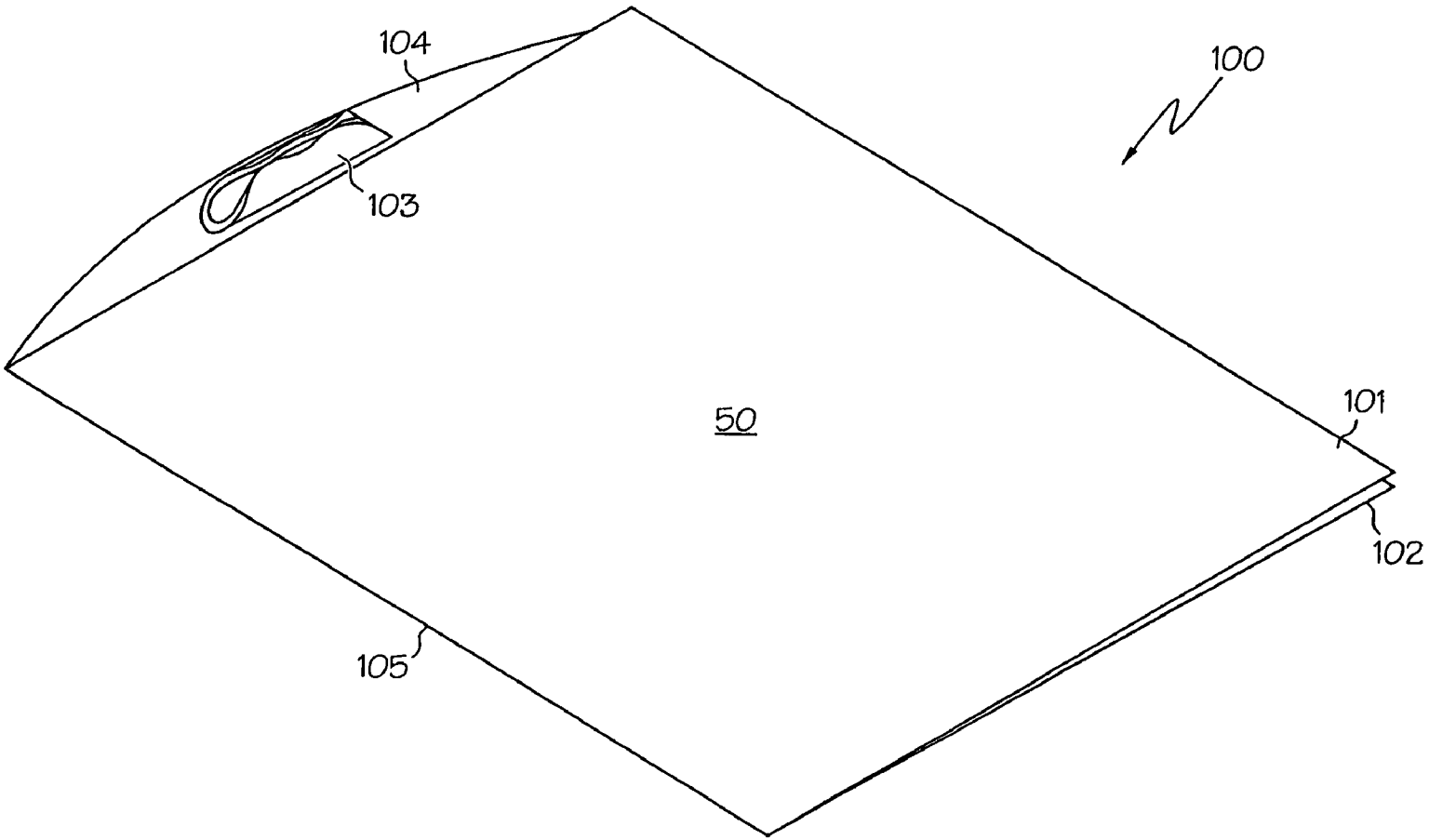
FIG. 11 is a front perspective view of a folder including a writing surface.

As shown in FIG. 11, in a fourth embodiment a folder 100 includes a front cover 101, a back cover 102 and a pen/pencil holder 103. The front cover 101 is pivotally connected to the back cover 102 along a pivot edge 105. The back cover 102 may have a surface area larger than that of the front cover 101 to define a protruding portion 104 that extends upwardly beyond the front cover 101 to provide an area for attaching the pen/pencil holder 103. The entire folder 100 may be constructed from an appropriate material such that the entire folder 100 is made of or forms a writing surface 50. Alternatively, only a portion of the front or back covers 101, 102 may be made of or include the writing surface 50.

Figure 12:
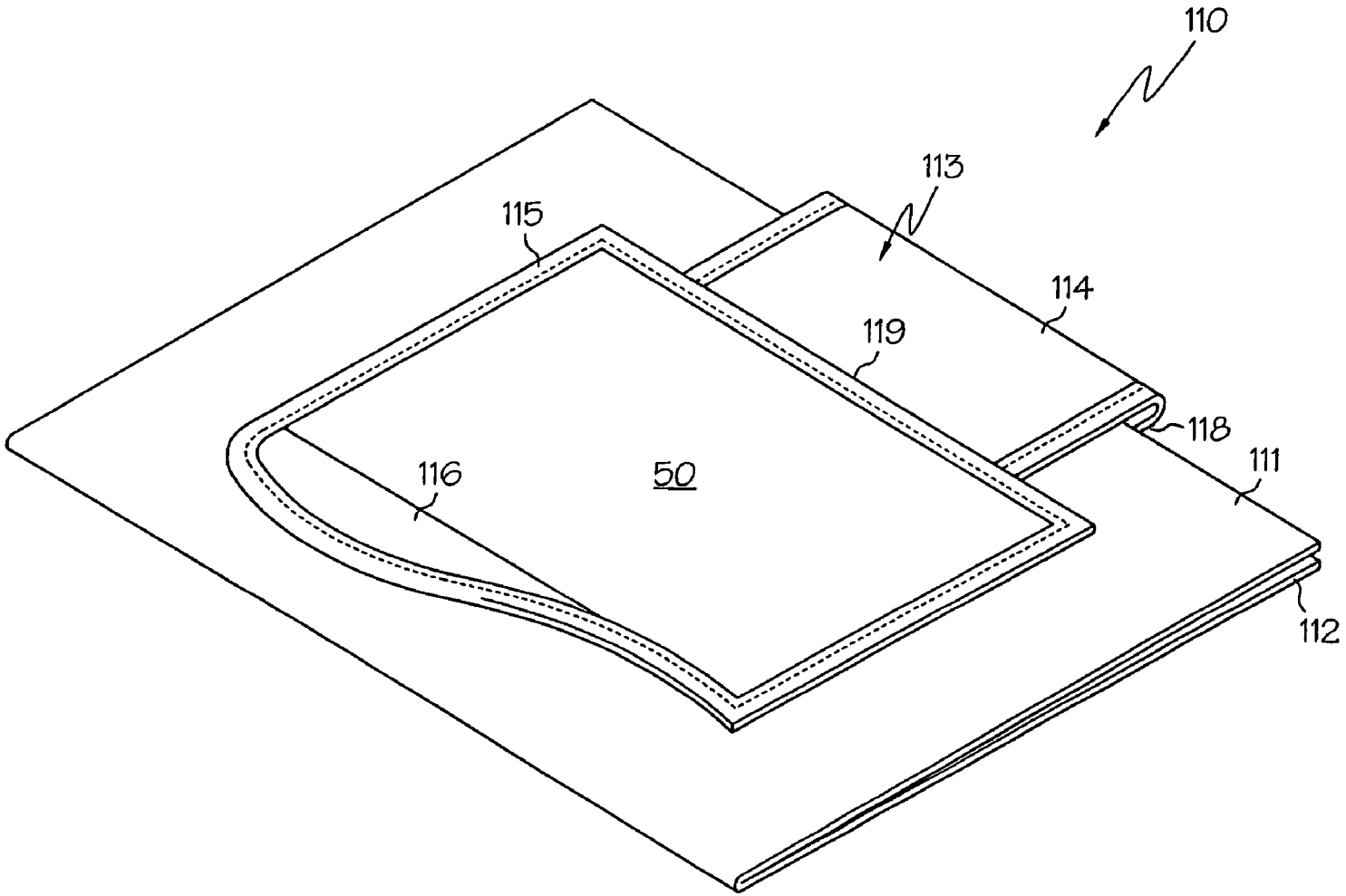
FIG. 12 is a front perspective view of a book cover including a closure mechanism, with the closure mechanism in a closed position.
Figure 13:
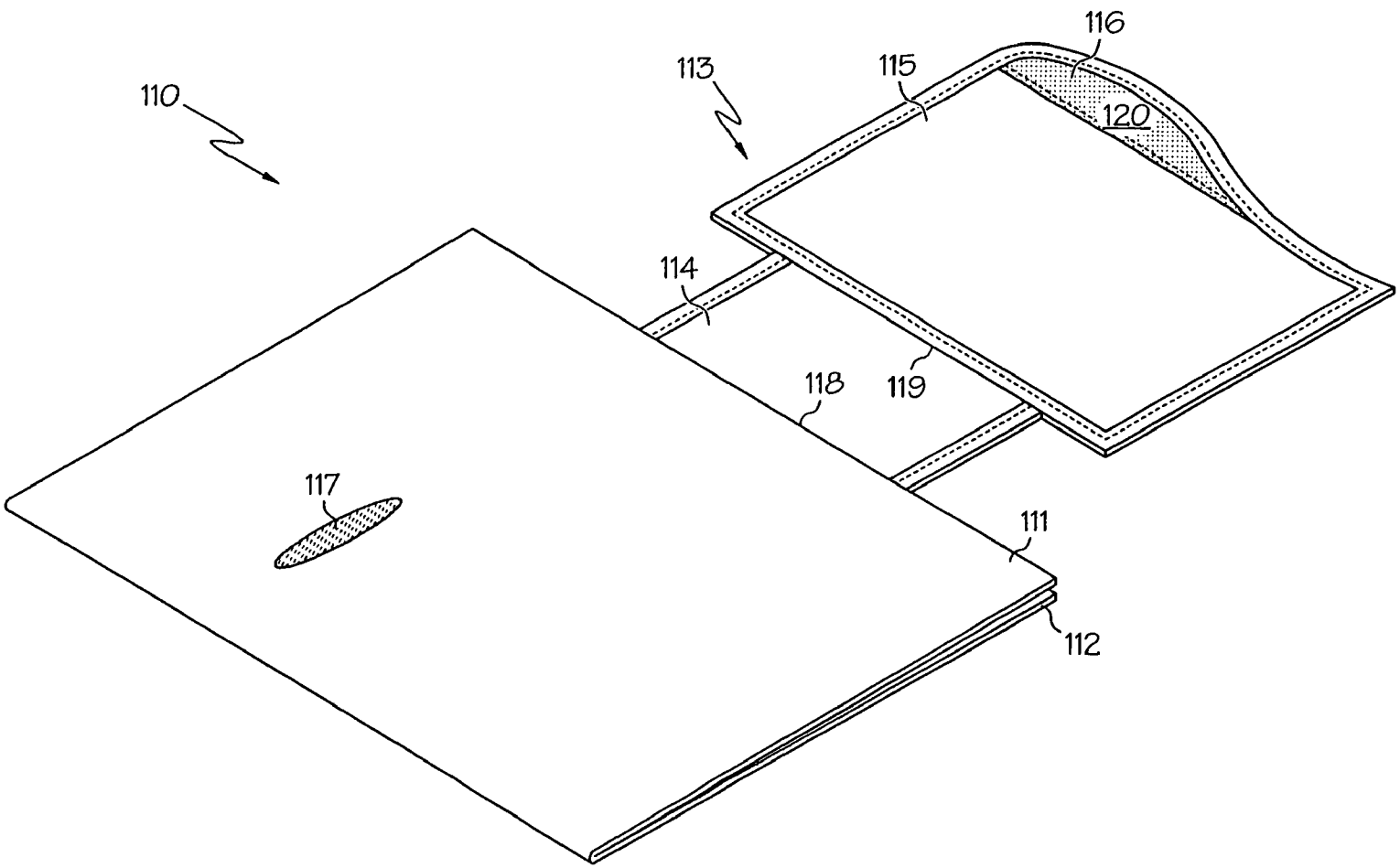
FIG. 13 is a front perspective view of the book cover of FIG. 12 with the closure mechanism in an open position.
Figure 14:
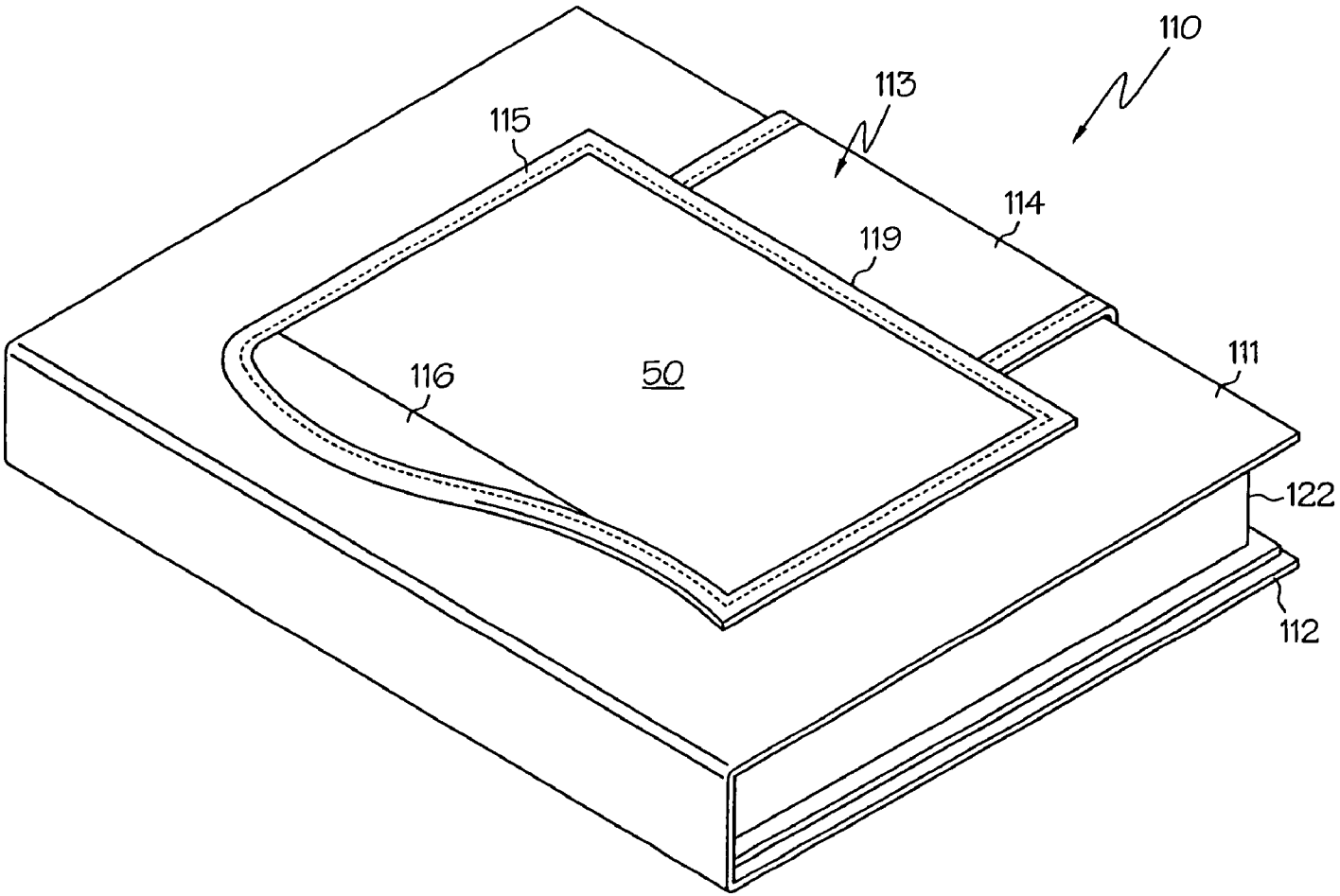
FIG. 14 is a front perspective view of the book cover of FIG. 12 positioned on a book.

As shown in FIGS. 12-14, in a fifth embodiment a book cover 110 includes a front cover portion 111, a back cover portion 112 and a closure mechanism 113. The front and back cover portions 111, 112 are adapted to be received over or around the front and back covers of a book 122 (FIG. 14), respectively, and may be constructed from various materials such as cloth, polymeric-type material, cellulose-based materials such as paper or cardboard, or the like. The closure mechanism 113 includes an elastic portion 114, a writing surface portion 115 having a writing surface 50 and a securing device 116. A first end 118 of the elastic portion 114 is attached to the back cover portion 112 and a second end 119 is connected to the writing surface portion 115.

The securing device 116 includes hook-and-loop fastening material 120 located on the underside of the writing surface portion 115 (see FIG. 13). The hook-and-loop fastening material 120 is configured to engage the corresponding hook-and-loop material 117 affixed to the front cover portion 111 to secure the book cover 110 in the closed position (see FIG. 12). Of course, various other securing devices, as discussed previously, can be used in place of the hook-and-loop fastening material 120.

Rather than being part of a school or office product, the writing surface 50 may simply be a "stand-alone" board such that the writing surface 50 can operate as a bulletin board, and, for example, be coupled to a locker, wall, refrigerator or the like, or be loosely carrier. Thus the writing surface 50 may include magnets, patches of hook-and-loop fastening material (i.e. VELCRO®), hook, snap, clasp, adhesive or other fasteners located on a rear side thereof to aid in attaching the writing surface 50 to various other components. Further, the marker 10 (which may include the cap 40) may be packaged together with the writing surface 50 for sale such that the marker 10 and writing surface 50 are marketed and sold together.

Figure 15:
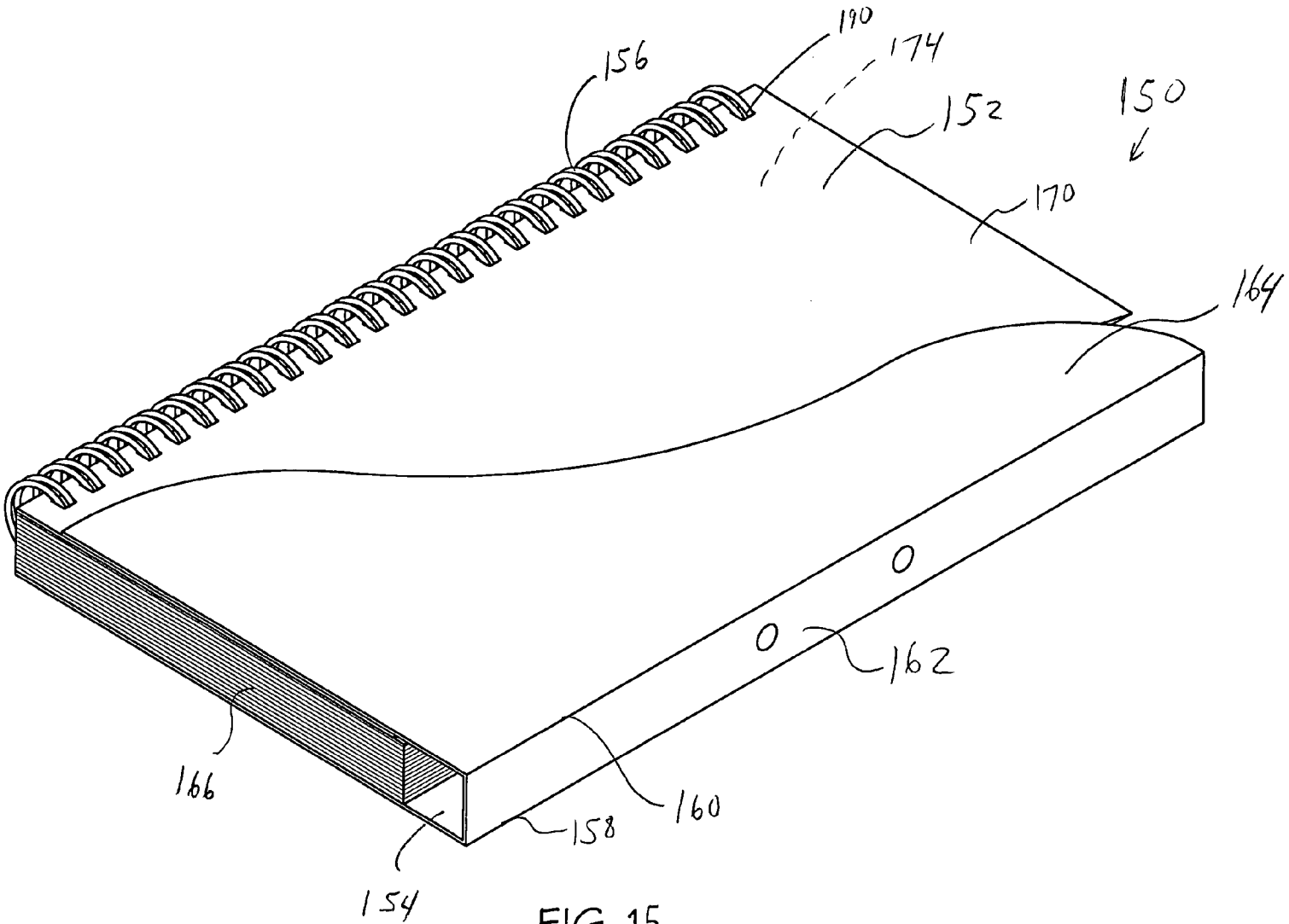
FIG. 15 is a front perspective view of a bound component, shown in its closed position.

As shown in FIG. 15, in yet another embodiment of the invention, a bound component 150 includes a front cover 152 and rear cover 154 bound together by a binding mechanism 156, such as a coil-binding mechanism. In the illustrated embodiment, the rear cover 154 includes a pair of fold lines 158, 160 defining a connection portion 162 and a cover flap 164 such that part of the rear cover 154 can be wrapped around and located on top of the front cover 152. A plurality of sheets of paper 166, such as pulp-based or cellulose-based paper, may be located between the front 152 and rear 154 covers and bound together and to the front 152 and rear 154 covers by the binding mechanism 156. In the illustrated embodiment, the binding mechanism 156 takes the form of a coil wire or twin wire binding mechanism, although the binding mechanism 156 may take any of a wide variety of forms, including but not limited to, spiral wire, adhesive, three-ring binding mechanisms, etc.

Figure 16:
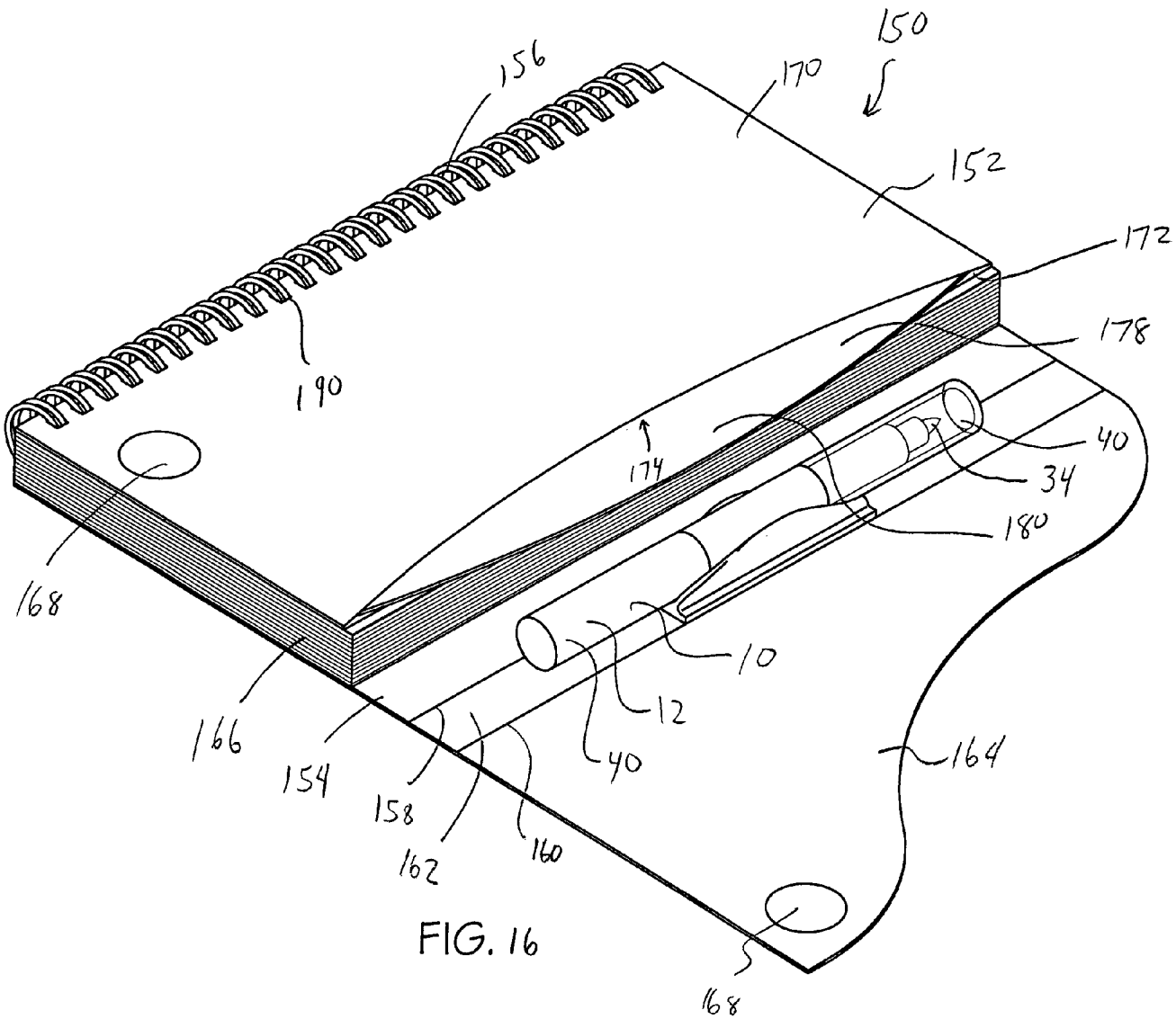
FIG. 16 is a front perspective view of the bound component of FIG. 15, shown in its open position.

As shown in FIG. 16, the front cover 152 and the cover flap 164 may include corresponding patches 168 of hook-and-loop fastening material (such as VELCRO®) located thereon to secure the cover flap 164 to the front cover 152. Of course, any of a wide variety of other fastening materials, such as snaps, clasps, adhesives and the like may be utilized to secure the cover flap 164 to the front cover 152. In the illustrated embodiment, the writing instrument, such as the marker or writing instrument 10 described and shown above, may be coupled to the connecting portion 162 of the rear cover 154.

The front cover 152 may take the form of a pocket including a pair of generally flat, opposed pocket panels 170, 172 defining an inner cavity 174 therebetween. The pocket panels 170, 172 may coupled together along two edges (i.e., their short outer edges), such as by heat welding, sonic welding, adhesives, stitching, or the like. In addition, the pocket panels 170, 172 may be coupled together along their long inner binding edges by similar means, and/or by the binding mechanism 156.

A writing surface 178 is slidably disposed in the inner cavity 174. The writing surface 178 may have the same qualities as the writing surface 50 described above. Thus, the writing surface 178 can be made of a polymer material, and more particularly, polypropylene or polyethylene. The writing surface 178 may be made of material which is chemically resistant (i.e., resists damage or is generally chemically inert) to solvent of the marking instrument 10. The writing surface 178 may have an average surface roughness of between about 50 and about 1000 microns. In addition, if desired, the pocket panels 170, 172 (i.e., the front cover 152) and the rear cover 154 may also have the same properties as the writing surface 50 described above.

Figure 17:
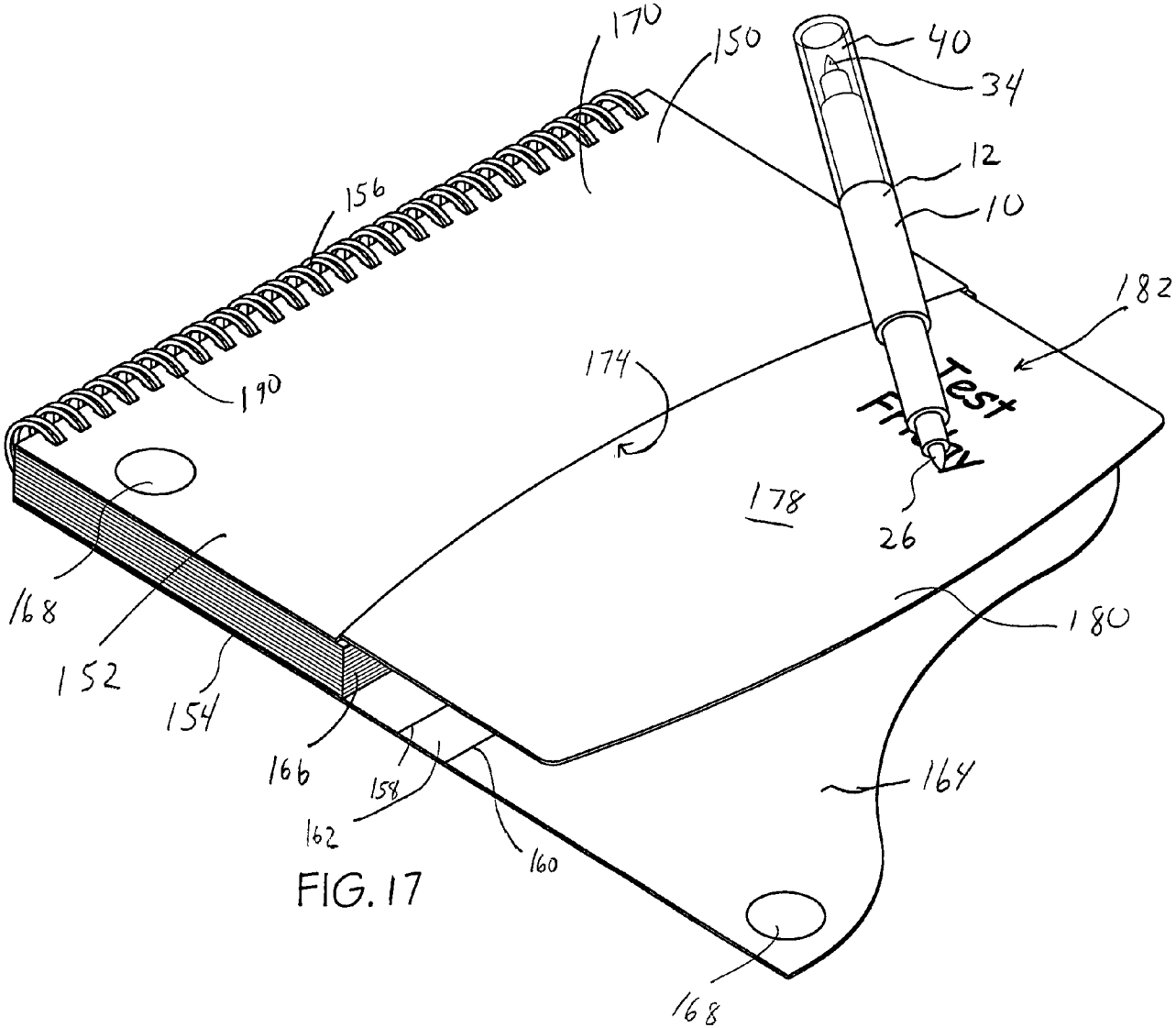
FIG. 17 is a front perspective view of the bound component of FIG. 15, shown with the writing surface in the extended position and being written upon by a writing instrument.

The writing surface 178 is movable between a retracted position wherein the writing surface 178 is generally received within the cavity 174 (FIG. 16) and an extended position wherein the writing surface 178 generally protrudes outwardly from and is generally not located within the inner cavity 174 (FIG. 17). The writing surface 178 is movable in a first direction when the writing surface 178 moves from the retracted position to the extended position. The writing surface 178 may be generally flat and planar, and the writing surface 178 is slidable between the extended and retracted positions in a direction generally parallel to the plane.

The pocket 152 is sized to generally closely receive the writing surface 178 therein when the writing surface 178 is in the retracted position. Various amounts of the writing surface 178 may be exposed/covered when the writing surface 178 is in either the retracted or extended position. For example, in the embodiment shown in FIG. 16, at least about 90% of the surface area of the writing surface 178 may be located in the cavity 174 of the pocket 170 when the writing surface 178 is retracted. In the illustrated embodiment a portion 180 of the writing surface 178 protrudes outwardly from the inner cavity 174 to allow the user to grip and pull the writing surface 178 into the extended position. However, various other proportions of the writing surface 178 may be located in the inner cavity 174 when the writing surface 178 is in the retracted position. For example, in one embodiment, at least about 60% of the surface area of the writing surface 178 is located in the cavity 174 when the writing surface 178 is in the retracted position.

In addition, various proportions of the writing surface 178 may be exposed when the writing surface 178 is in the extended position. For example, in the embodiment shown in FIG. 17, at least about 80% of the writing surface 178 is exposed when the writing surface 178 is extended. However, various other configurations may be utilized. For example, in one embodiment, at least about 60% of the surface area of the writing surface 178 may be exposed for writing upon when the writing surface 178 is in the extended position.

As shown in FIG. 17, the writing surface 178 provides a convenient surface upon which reminders, notes, drawings or other indicia 182 can be marked. In particular, in one embodiment, the writing instrument 10 may be utilized to mark the indicia on the writing surface using writing tip 26. Once the indicia 182 is so marked on the writing surface 178, the writing surface 178 can be returned to the retracted position, as shown in FIG. 16. In this case, the writing surface 178/pocket 152 allows the bound component 150 to maintain a clean outer appearance, and hides the indicia 182 from view to protect sensitive information.

Figure 18:
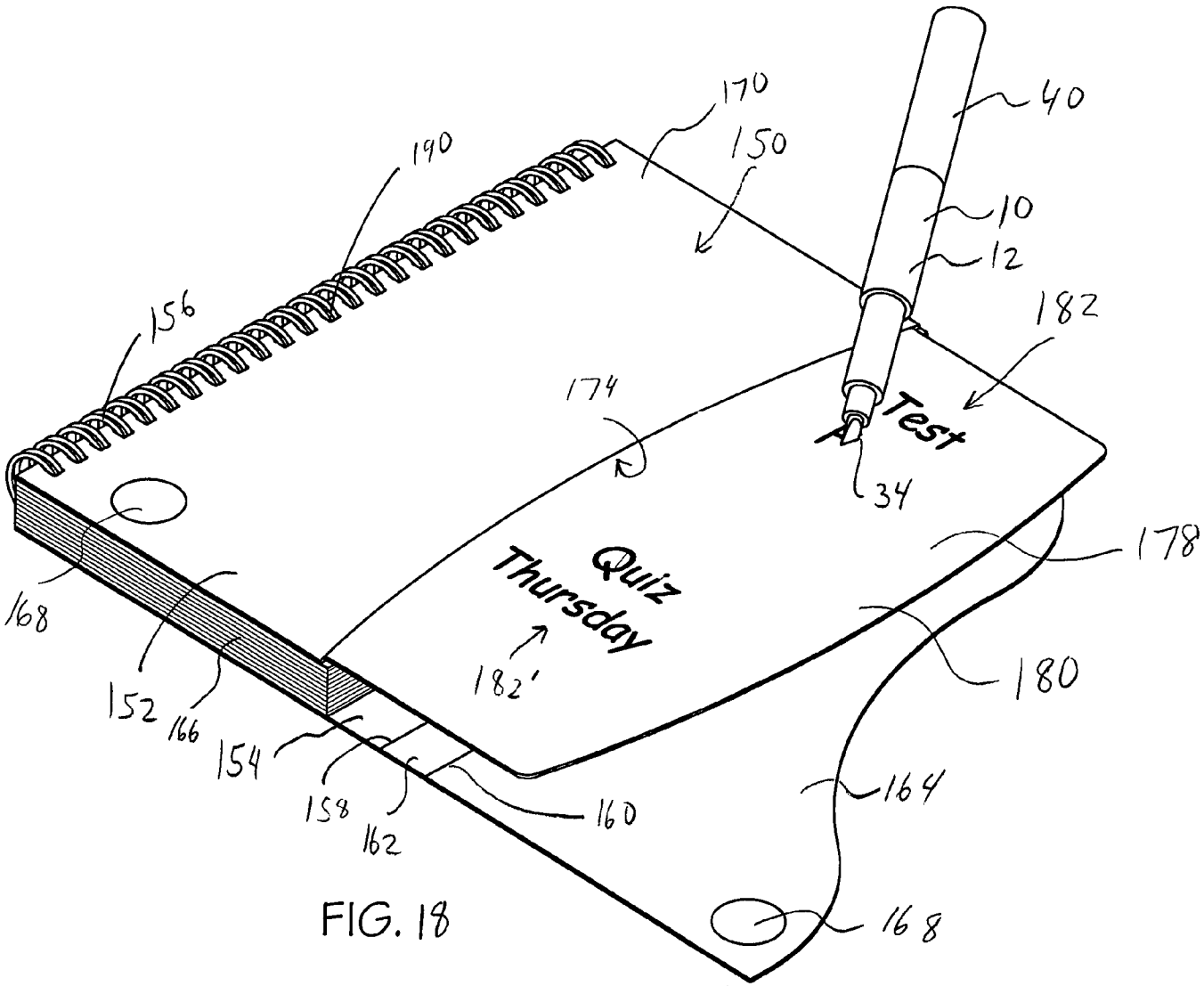
FIG. 18 is a front perspective view of the bound component of FIG. 17, with the markings being erased by the writing instrument.
Figure 19:
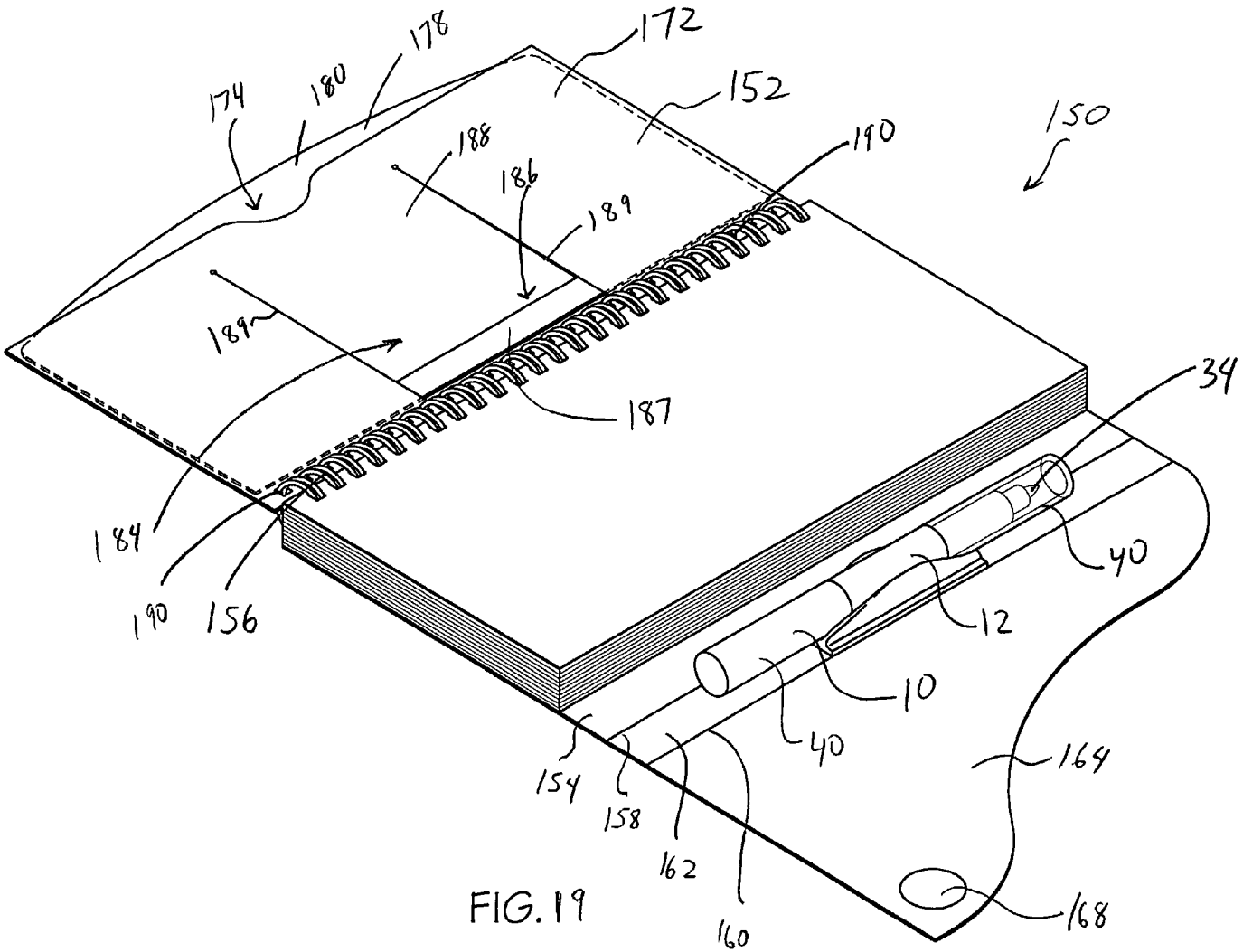
FIG. 19 is a front perspective view of the bound component of FIG. 16, with the pocket pivoted about the binding mechanism.
Figure 20:
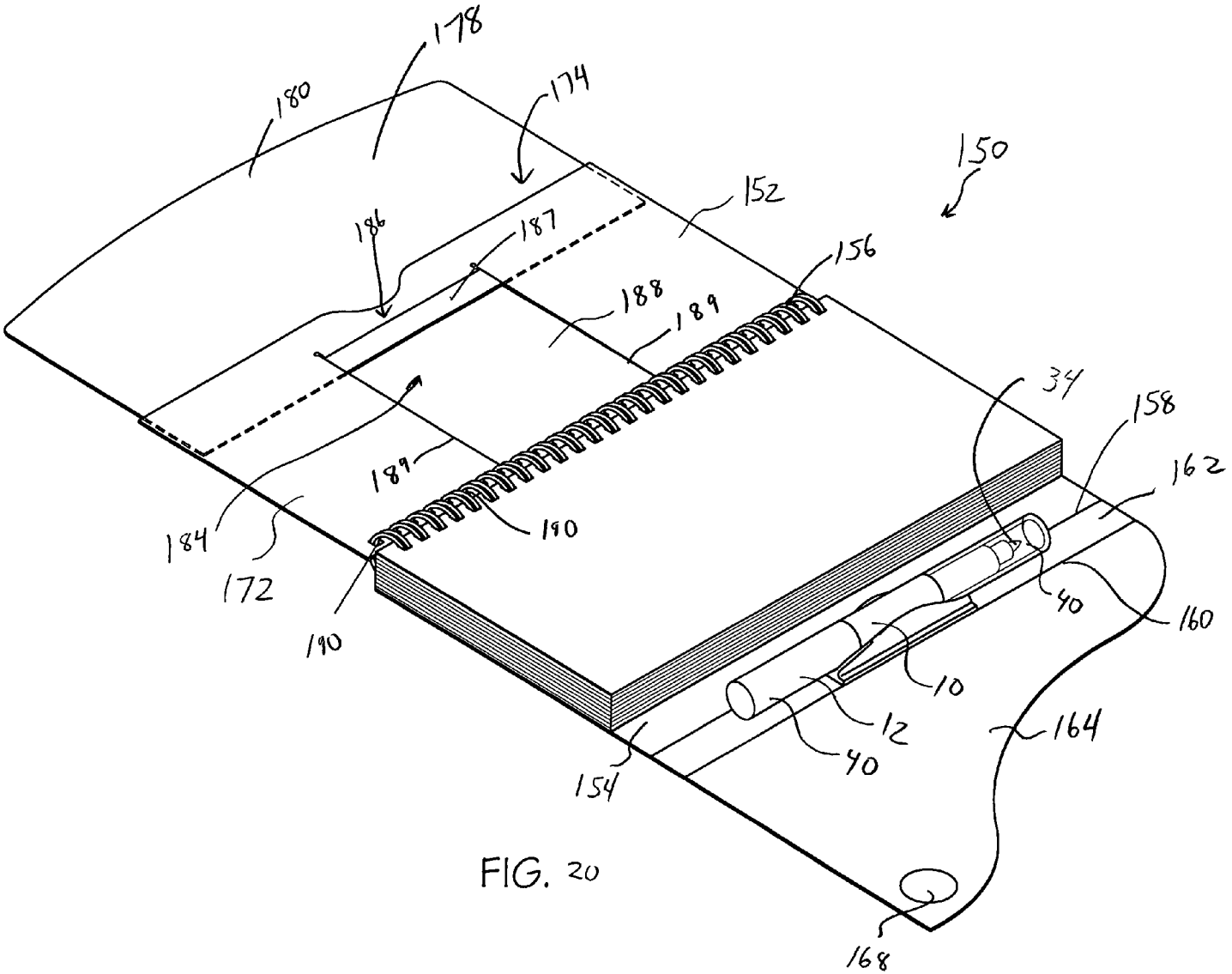
FIG. 20 is a front perspective view of the bound component of FIG. 19, with the writing surface in the extended position.

Of course, the writing instrument 10/writing surface 178 may also allow the indicia 182 to be removed therefrom (FIG. 18) using the erasing tip 34 as described in detail above. New reminders or indicia 182' can be marked on the writing surface 178. Thus, as old reminders or indicia are desired to be removed, the indicia on the writing surface 178 can be erased and the writing surface 178 can be continually reused. Of course, if desired, the writing instrument 10 may also be used to write indicia on the front 152 or rear 154 covers (including the pocket panels 170, 172) to mark reminders or other indicia thereon.

Figure 21:
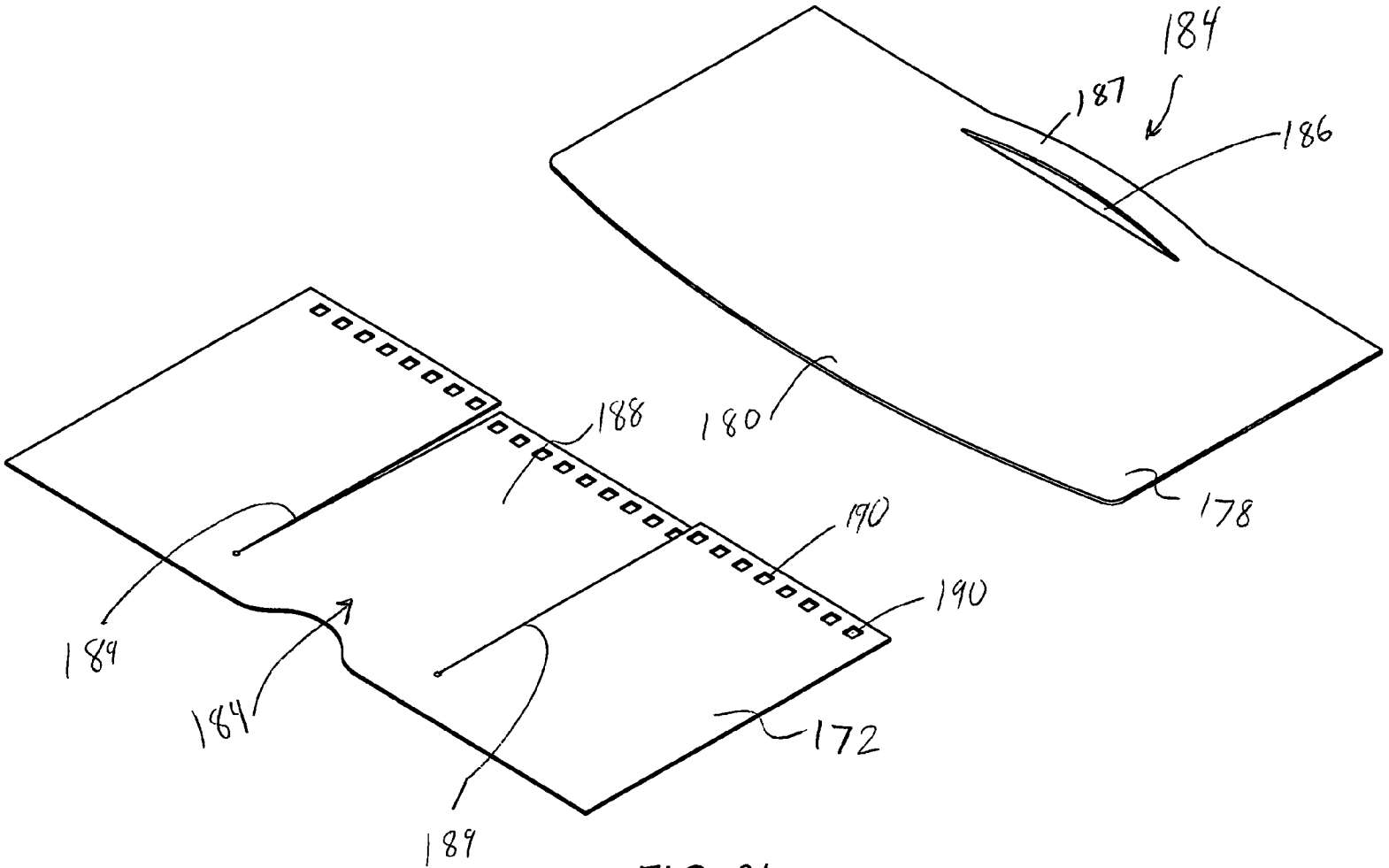
FIG. 21 is a front perspective exploded view of part of the pocket and writing surface of the bound component of FIG. 16.
Figure 22:
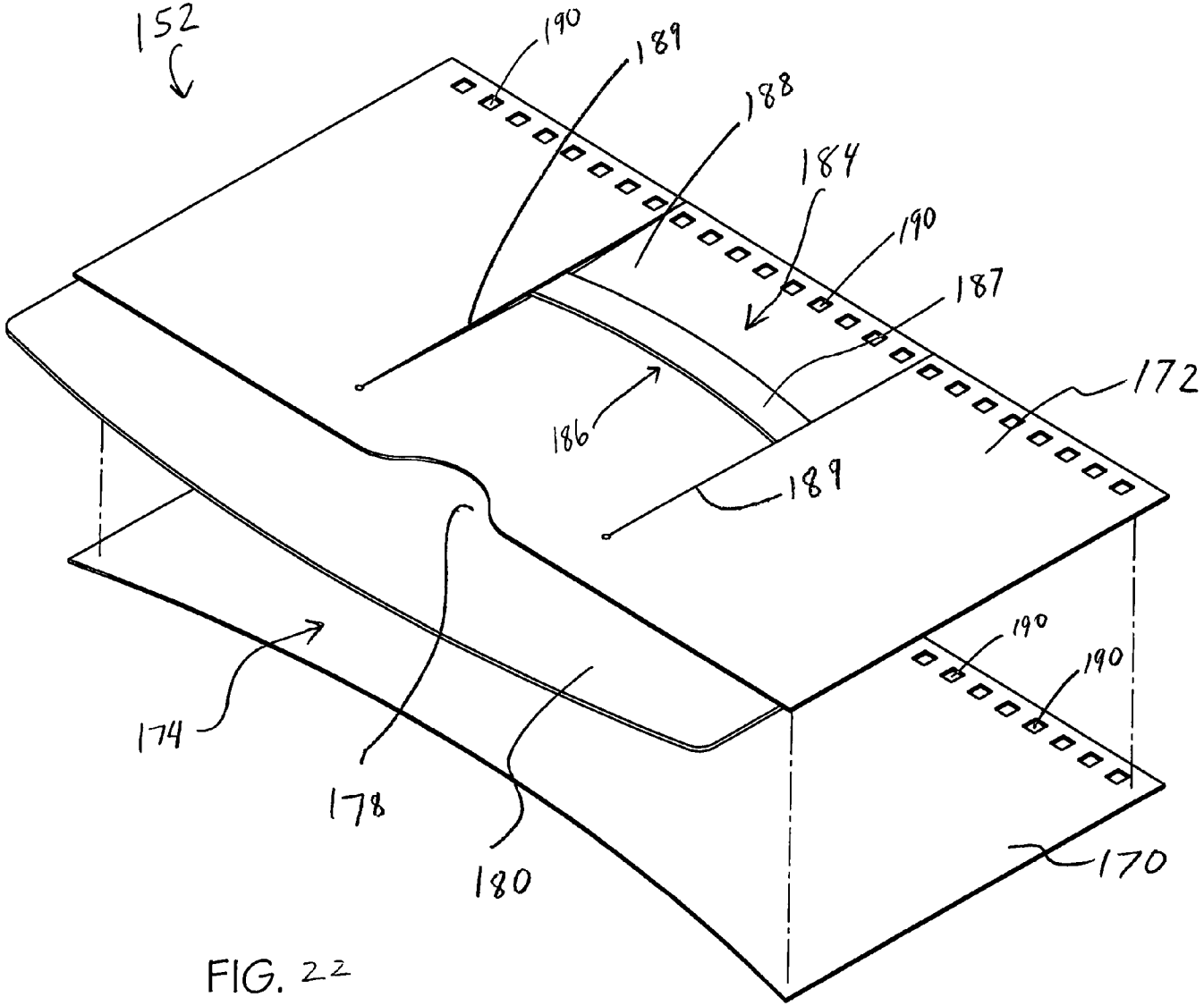
FIG. 22 is a front exploded perspective view of the pocket.

The bound component 10 may include a retaining structure 184 which limits the movement of the writing surface 178 in the first direction. In particular, as best shown in FIG. 21, the writing surface 178 may include an internal slit 186 that is entirely spaced apart from the outer perimeter of the writing surface 178. The slit 186 may extend in a direction generally perpendicular to the first direction and defines an end portion 187. The pocket panel 172 includes a flap 188 defined by a pair of cuts 189 that extend generally perpendicular to the slit 186. Each cut 189 intersects an outer perimeter of the pocket panel 172 and extends generally parallel to the first direction. The flap 188 is sized to be closely slidably received through the slit 186, as shown in FIG. 22. In addition, when the flap 188 is received through the slit 186, the end portion 187 of the writing surface 178 is located on top of the flap 188. The remaining pocket panel 170 is located below the writing surface 178 in the configuration in FIG. 22 to trap the writing surface 178 in the inner cavity 174 of the pocket 150 (i.e., when the panels 170, 172 are bound to the binding mechanism 156).

In this manner, when the pocket panel 172 and writing surface 178 are arranged in the configuration shown in FIG. 22 and the writing surface 178 is moved to the fully extended position (i.e., to the left of the position shown in FIG. 22), the end portion 187 of the writing surface 178 engages the base end of the flap 188 to limit the movement of the writing surface 178. The retaining structure 184 thereby prevents the writing surface from being completely pulled out of the inner cavity 174. In addition, once the binding mechanism 156 is passed through the binding holes 190 of the pocket panels 170, 172, the writing surface 178 is securely coupled to and trapped within the front cover 152.

If desired, the location of the slit 186 and flap 188 may be reversed. In particular, in this case, the slit 186 may be located on one of the pocket panels 170, 172, and the flap 188 could be located on the writing surface 178. Of course, various other structures and mechanisms for retaining the writing surface 178 in the inner cavity may be used.

In this manner, the bound component 150 provides a retractable writing surface which allows notes to be written thereon, but which can be retracted to maintain a clean outer appearance and protect sensitive information. A permanent ink writing instrument and erasing means can be utilized to allow information to be securely, yet removably, written thereon.

Although the invention is shown and described with respect to certain embodiments, it is obvious that equivalents and modifications will occur to those skilled in the art upon reading and understanding the specification. The present invention includes all such equivalents and modifications and is limited only by the scope of the claims.

What is claimed is:

1. A retractable writing surface system comprising:

a binding mechanism;

a pocket directly bound to said binding mechanism, said pocket including a pair of opposed pocket panels having an inner cavity therebetween, one of said pocket panels comprising a flap; and a polymer writing surface at least partially received in said pocket, said writing surface comprising an internal slit;

wherein said writing surface is movable between an extended position wherein at least part of said writing surface is exposed for writing upon by a writing instrument, and a refracted position wherein less of said writing surface is exposed for writing upon by said writing instrument compared to when said writing surface is in said extended position, wherein at least part of said writing surface is located in said cavity when said writing surface is in said retracted position; and wherein said flap is slidably received by said internal slit to retain said writing surface so that said writing surface in said extended position remains attached to said pocket.

2. The system of claim 1 wherein said writing surface is generally flat and lies in a plane, and wherein said writing surface is slidable between said extended and said retracted positions in a direction generally parallel to said plane.

3. The system of claim 1 further comprising a plurality of sheets of paper bound to said binding mechanism and to said pocket.

4. The system of claim 1 wherein said binding mechanism is a coil wire or spiral wire binding mechanism.

5. The system of claim 1 wherein said pocket is made of a polymer material.

6. The system of claim 1 wherein said writing surface is polypropylene or polyethylene.

7. The system of claim 1 wherein said writing surface has an average surface roughness of between about 50 and about 1000 microns.

8. The system of claim 1 wherein said writing surface is movable in a first direction when said writing surface moves from said retracted position to said extended position, and wherein said retaining structure limits the movement of said writing surface in said first direction.

9. The system of claim 1 wherein said writing surface includes an outer perimeter, and wherein said slit is entirely spaced apart from said outer perimeter.

10. The system of claim 1 wherein said writing surface is movable in a first direction when said writing surface moves from said retracted to said extended position, and wherein said slit extends in a second direction that is generally perpendicular to said first direction.

11. The system of claim 10 wherein said flap is defined by a pair of cuts formed in said one of said pocket panels, each cut intersecting an outer perimeter of said one of said pocket panels and extending generally parallel to said first direction.

12. The system of claim 1 wherein said pocket is sized to closely receive said writing surface therein when said pocket is in said retracted position.

13. The system of claim 1 wherein at least about 60% of a surface area of said writing surface is exposed for writing upon by said writing instrument when said writing surface is in said extended position, and wherein at least about 60% of the surface area of said writing surface is located in said cavity when said writing surface is located in said retracted position.

14. The system of claim 1 further comprising a permanent writing instrument configured to dispense permanent markings on said writing surface, and wherein said system further includes erasing means for erasing permanent markings, wherein said writing instrument and said erasing means are directly or indirectly coupled to said binding mechanism, said pocket or said writing surface.

15. The system of claim 14 wherein said permanent writing instrument is configured to dispense a solvent based permanent ink.

16. The system of claim 15 wherein said writing surface is made of a polymeric material that is chemically resistant to said solvent.

17. The system of claim 14 wherein said permanent markings generally resist removal by soap and water.

18. The system of claim 14 wherein said erasing means is positioned on said writing instrument.

19. The system of claim 14 further comprising a cover made of a polymer material that is bound to said plurality of sheets by said binding mechanism, and wherein said cover is configured to receive permanent marking thereon from said writing instrument, and wherein said permanent markings on said cover are erasable by said erasing means.

20. A marking system comprising:

a permanent writing instrument configured to dispense permanent markings;

erasing means for erasing said permanent markings;

a pocket including a pair of opposed pocket panels, one of said pocket panels comprising a flap; and a writing surface directly or indirectly coupled to said writing instrument and said erasing means, said writing surface comprising an internal slit, wherein said writing surface is configured such that said marking portion is able to dispense said permanent markings thereon and wherein said markings on said writing surface are erasable by said erasing means, wherein said writing surface is movable relative to said pocket between an extended position wherein at least part of said writing surface is exposed for writing upon by said writing instrument, and a retracted position wherein less of said writing surface is exposed for writing upon by said writing instrument compared to when said writing surface is in said extended position, wherein said flap is slidably received by said internal slit to retain said writing surface so that said writing surface in said retracted position is at least partly located within said pocket, and in said extended position remains attached to said pocket.

21. The system of claim 20 wherein said writing instrument is configured to dispense a solvent based permanent ink.

22. The system of claim 21 wherein said writing surface is made of a polymeric material that is chemically resistant to said solvent.

23. The system of claim 20 wherein said permanent markings generally resist removal by soap and water.

24. The system of claim 20 wherein said writing surface is made of polypropylene or polyethylene.

25. The system of claim 20 wherein said erasing means is positioned on said writing instrument.

26. The system of claim 20 wherein said writing surface has an average surface roughness of between about 50 and about 1000 microns.

27. The system of claim 20 further comprising a cover made of a polymer material that is bound to said plurality of sheets by said binding mechanism, and wherein said cover is configured to receive permanent marking thereon from said writing instrument, and wherein said markings on said cover are erasable by said erasing means.

28. The system of claim 20 wherein said a pocket has an inner cavity, said wherein said pocket slidably receives said writing surface in said inner cavity.

29. The system of claim 28 wherein at least part of said writing surface is received in said inner cavity of said pocket when said writing surface is in a retracted position.

30. The system of claim 28 wherein said pocket is sized to closely receive said writing surface therein when said pocket is in said retracted positions.

31. A method for using a bound component system comprising the steps of:

providing a bound component system including a bound component, a pocket including a pair of opposed pocket panels, one of said pocket panels comprising a flap, a writing surface coupled to said bound component, said writing surface comprising an internal slit;

a permanent writing instrument configured to dispense permanent markings, and erasing means for erasing said permanent markings, wherein said writing surface is located in an extended position wherein at least part of said writing surface is exposed for writing upon by said writing instrument, wherein said flap is slidably received by said internal slit to retain said writing surface so that said writing surface in said extended position remains attached to said bound component;

manually making permanent markings on said writing surface with said permanent writing instrument; and moving said writing surface to a retracted position wherein at least part of the said writing surface is within said pocket, and wherein less of said writing surface is exposed for writing upon by said writing instrument compared to when said writing surface is in said extended position.

* * * * *